US011064754B2

(12) United States Patent
Brine, III et al.

(10) Patent No.: US 11,064,754 B2
(45) Date of Patent: Jul. 20, 2021

(54) SPORT HELMET

(71) Applicant: Cascade Maverik Lacrosse, LLC, Exeter, NH (US)

(72) Inventors: William H. Brine, III, Hopkinton, MA (US); Jonathan Baker, Thornton, NH (US); Eric Darnell, South Strafford, VT (US); Steve Moore, Liverpool, NY (US); Joel Robinson, Oswego, NY (US); Barclay Moore, Homewood, CA (US); Romeo Graham, Chelsea (CA); Luc Boucher, Ottawa (CA); Rob Watters, Ottawa (CA); John Tutton, North Gower (CA)

(73) Assignee: Cascade Maverik Lacrosse, LLC, Exeter, NH (US)

( * ) Notice: Subject to any disclaimer, the term of this patent is extended or adjusted under 35 U.S.C. 154(b) by 236 days.

(21) Appl. No.: 16/408,430

(22) Filed: May 9, 2019

(65) Prior Publication Data

US 2019/0261722 A1 Aug. 29, 2019

Related U.S. Application Data

(63) Continuation of application No. 16/110,589, filed on Aug. 23, 2018, which is a continuation of application (Continued)

(51) Int. Cl.

*A42B 3/12* (2006.01)
*A42B 3/14* (2006.01)

(Continued)

(52) U.S. Cl.

CPC ..... *A42B 3/125* (2013.01); *A42B 3/00* (2013.01); *A42B 3/124* (2013.01); *A42B 3/145* (2013.01);

(Continued)

(58) Field of Classification Search

CPC ..... A42B 3/20; A42B 3/064; A42B 3/127; A63B 71/10

See application file for complete search history.

(56) References Cited

U.S. PATENT DOCUMENTS 3,122,752 A * 3/1964 Marietta ..... A42B 3/20 2/9
3,329,968 A 7/1967 Gordon (Continued)

FOREIGN PATENT DOCUMENTS

CA 2617829 C 9/2014
CA 2843715 C 3/2015

(Continued)

OTHER PUBLICATIONS

Examiner's Report dated Feb. 13, 2017 in connection with corresponding CA Application No. 2,843,717.

(Continued)

*Primary Examiner* — Clinton T Ostrup
*Assistant Examiner* — Andrew Wayne Sutton

(57) ABSTRACT

The helmet uses a new fastener to fasten a cage to the helmet shell allowing sides of the cage to be mounted directly against the shell, reducing the width of the shell on each side. A ball is attached to a portion of a bar of the cage to act as a limit stop precluding movements of the cage with respect to the helmet. A chin bar is fastened to the helmet at two points on each side of the shell. The shell is molded with recessed portions designed to receive the two branches of the chin bar on each side where they will be fastened to the shell so that the outer surfaces of the chin guard are flush with the shell at the locations of attachment to provide a smooth transition and reduce weight. An adjustment device to adjust the fit of the helmet to the user includes a star wheel on each side of the helmet attached to an arcuate flexible strip extending rearwardly around the occipital area of the (Continued)

skull. A sliding mechanism attached to the strip allows the strip to be moved forward and backward to allow it to be tightened or loosened, respectively, with respect to the player's head. A ratcheting lateral adjustment device is also disclosed.

34 Claims, 22 Drawing Sheets

Related U.S. Application Data

No. 13/954,706, filed on Jul. 30, 2013, now Pat. No. 10,219,576, which is a continuation of application No. 12/007,505, filed on Jan. 11, 2008, now Pat. No. 8,544,118.

(51) Int. Cl.

| | |
|---|---|
| ***A63B 71/10*** | (2006.01) |
| ***A42B 3/00*** | (2006.01) |
| *A63B 102/14* | (2015.01) |
| *A63B 102/22* | (2015.01) |

(52) U.S. Cl.

CPC ..... *A63B 71/10* (2013.01); *A63B 2102/14* (2015.10); *A63B 2102/22* (2015.10)

(56) References Cited

U.S. PATENT DOCUMENTS

| | | | | | |
|---|---|---|---|---|---|
| 3,946,466 | A | | 3/1976 | Sakai | |
| 3,984,875 | A | * | 10/1976 | Farquharson | A42B 3/08 2/10 |
| 4,021,858 | A | * | 5/1977 | Neeld | A42B 3/08 2/9 |
| 4,042,974 | A | * | 8/1977 | Morgan | A42B 3/326 2/9 |
| 4,689,836 | A | | 9/1987 | Vitaloni | |
| 5,129,108 | A | * | 7/1992 | Copeland | A42B 3/14 2/424 |
| 5,263,204 | A | | 11/1993 | Butsch | |
| 5,384,914 | A | | 1/1995 | Caveness | |
| 5,483,699 | A | | 1/1996 | Pernicka | |
| 5,571,220 | A | | 11/1996 | Hall | |
| 6,047,400 | A | * | 4/2000 | Spencer | A42B 3/20 2/424 |
| 6,189,156 | B1 | | 2/2001 | Loiars | |
| 6,367,085 | B1 | | 4/2002 | Berg | |
| 6,772,447 | B2 | | 8/2004 | Morrow | |
| 6,938,272 | B1 | * | 9/2005 | Brown | A42B 3/20 2/424 |
| 6,976,272 | B2 | | 12/2005 | Krzysik, Jr. | |
| 7,207,071 | B2 | | 4/2007 | Pierce | |
| 8,314,587 | B2 | | 11/2012 | White et al. | |
| 8,656,520 | B2 | | 2/2014 | Rush | |
| 10,219,576 | B2 | | 3/2019 | Brine, III et al. | |
| 2004/0117897 | A1 | | 6/2004 | Udelhofen | |
| 2007/0245468 | A1 | | 10/2007 | Butler | |
| 2011/0271427 | A1 | * | 11/2011 | Milsom | A42B 3/122 2/413 |
| 2011/0271428 | A1 | | 11/2011 | Withnall et al. | |
| 2016/0021966 | A1 | | 1/2016 | Warmouth | |
| 2019/0021431 | A1 | | 1/2019 | Brine et al. | |

FOREIGN PATENT DOCUMENTS

| | | | |
|---|---|---|---|
| WO | WO 02/28213 | A1 | 4/2002 |
| WO | WO 2005/115188 | A1 | 12/2005 |

OTHER PUBLICATIONS

[No Author Listed] Warrior: 2006 Men's Equipment Guide. Warrior Sports. 2006, pp. 1, 45-48.

[No Author Listed] Gait by deBeer. deBeer Lacrosse Equipment Catalogue. 2006, pp. 1-7.

U.S. Appl. No. 16/110,589, filed Aug. 23, 2018, Brine et al.

* cited by examiner

SPORT HELMET

CROSS-REFERENCE TO RELATED APPLICATIONS

This application claims the benefit of and is a continuation of U.S. application Ser. No. 16/110,589, filed Aug. 23, 2018, entitled "SPORT HELMET", which is a continuation of U.S. application Ser. No. 13/954,706, filed Jul. 30, 2013, now U.S. Pat. No. 10,219,576, which is a continuation of U.S. application Ser. No. 12/007,505, filed Jan. 11, 2008, now U.S. Pat. No. 8,544,118. The entire contents of these applications are incorporated herein by reference in their entirety.

FIELD OF THE INVENTION

The present invention relates to an improved sport helmet usable by players in any contact sport, but preferably for players in the games of lacrosse and hockey.

BACKGROUND OF THE INVENTION

Helmets for use by players playing the games of lacrosse and hockey are well known in the prior art, generally. Such helmets typically include a hard shell with internal padding, vent holes, a face guard in the form of a cage, on some helmets a chin guard, sometimes a chin strap, and a variety of other aesthetic and/or functional features.

U.S. Pat. Nos. 6,772,447 and 6,883,183, both to Morrow et al., teach the details of a sport helmet preferably used as a lacrosse helmet. These patents are related with their underlying applications being a parent application and continuation application.

The Morrow et al. patents teach a hard shell, internal padding, a face guard consisting of a wire cage having peripheral P-shaped connection means, and either a padded chin guard attached at the bottom of the cage or a chin bar attached to the helmet and cage without a pad. Also taught by Morrow et al. are a chin strap, internal padding within the shell, and a plurality of ventilation holes in the shell. Although the Morrow et al. patents demonstrate that each of these features is generally known in the prior art, there is room for improvement with regard to each of these features, particularly concerning the desirability of enhancing performance, both from an aesthetic standpoint and structurally to improve player safety and effectiveness.

The Morrow et al. shell includes basic padding consisting of an inner liner including a crown layer and a lower liner portion. These padding structures are disclosed as constructed of vinyl nitrol, a laminate described as BUCK-TEX® or, alternatively, any soft and non-abrasive material having moisture management/wicking characteristics. Such padding in a sport helmet is typical of sport helmets used today. Thus, there is a need for an improved padding for a sport helmet that takes into account anticipation of such impacts and a solution to protect the wearer.

On typical sport helmets such as those disclosed by Morrow et al., the manner of attachment of the face guard or cage to the front of the helmet is through a series of P-shaped clips that are attached to the shell via screws that are screwed into holes in the helmet provided for that purpose. Such clips have a thickness underlying the cage that results in spacing of the cage from the shell on each side to the distance of the inner portion of each clip. As a result, the cage must be made slightly wider than would otherwise be the case, thereby resulting in increased weight and bulkiness for a helmet. A different connection system that would result in reduction of weight and bulkiness would be an improvement for the wearer.

In a further aspect, in a face guard such as that which is shown in the Morrow et al. patents, the P-shaped clips fasten the face guard to the shell, but do nothing to preclude vertical sliding movements of the face guard with respect to the clips. Thus, impacts to the face guard can cause sliding movement of the cage that can hurt the user and/or damage the helmet. If a system were devised to reduce such sliding movements of the cage with respect to the shell, these issues could be resolved.

In a further aspect, prior art sport helmets, particularly those used in lacrosse and hockey, have a chin bar that is typically attached to the shell at two points, one on each side. One example of such a helmet is The Sport Helmets Inc. Cascade CPX helmet which includes a single point of attachment on each side of the shell for the chin bar with additional attachments on the lower portion of the cage. In a further aspect, the shell is made with a smooth surface adjacent the locations of attachment of the chin bar so that the chin bar is mounted in overlying relation to those smooth surfaces with a screw used to attach each side of the chin bar at those locations. In a similar fashion to the description hereinabove concerning the cage, with the chin guard overlying the sides of the shell, the chin bar must be made slightly wider than the shell at those locations to accommodate this mounting. This adds additional weight and bulkiness. Thus, it would be advantageous to devise a chin bar that resolves these issues.

Sport helmets, particularly for the games of lacrosse and hockey, are typically made with a shell molded in a limited number of sizes. The heads of different players are always sized differently, both in shape and circumference. Some helmets have been devised with adjustment means to custom-fit a helmet to a particular player, however, such adjustment means are typically only adjusted at the point of purchase and never adjusted again. The fit of a helmet to a player may change over time based upon many factors including nothing more complex than the length and volume of the player's hair. Thus, the ability to easily change the custom-fit of a helmet by the player would be advantageous in ensuring that the helmet is always comfortable to the player and the player is not conscious of the helmet while playing the game.

It is with the thoughts in mind to devise a sport helmet in which improvements are made with regard to each of these features that the present invention was developed.

SUMMARY OF THE INVENTION

The present invention relates to an improved sport helmet usable in a variety of games, but particularly for the games of lacrosse and hockey. The present invention includes the following interrelated objects, aspects and features:

(1) In a first aspect, the present invention contemplates an improvement over prior art sport helmets in the area of padding mounted inside the internal shell. In this regard, Applicants' Assignee is also the assignee of U.S. patent application Ser. No. 11/229,626, filed Sep. 20, 2005, and disclosing a lateral displacement shock absorbing material. The teachings of that patent application are incorporated by reference herein. The shock absorbing material disclosed in Applicants' Assignee's prior U.S. patent is incorporated into a sport helmet in accordance with the teachings of the present invention. In particular, the version of the lateral displacement shock absorbing material utilized in the helmet disclosed herein consists of a plurality of distinct sets of cushioning devices, each having seven parallel tubes, in the preferred embodiment, connected together with laterally extending webbing, with each set of seven tubes located at a crucial area of the inner shell of the inventive helmet. An armature is provided that facilitates mounting each set of tubes in a desired location, with the armature and the tubes as connected together mounted within the inner shell of the helmet in a desired manner. Additional padding is provided between the tubes and armatures and the head of the user which padding is designed to work with the tubes to spread forces imposed on the shell throughout the padding to reduce the potential for damage to the head of the player.

(2) The present invention also contemplates an improvement in the cage of a sport helmet to increase the effectiveness of its mounting while reducing its bulk and weight. Thus, instead of using the typical P-shaped plastic clips, a new fastener is provided which allows the sides of the cage to be mounted directly against the shell, thereby reducing the width of the shell on each side by one-half the thickness of the prior art P-shaped fasteners. The new fasteners extend on the inside and outside of the shell and include a recess between the inner and outer portions that receives a bar of the cage.

(3) As explained hereinabove, the fastening means for the cage typically allows the cage to move up and down with respect to the shell upon receipt of impacts. To solve this problem, the present invention contemplates providing a protrusion such as a ball, welded or otherwise attached to a portion of a bar of the cage, that acts as a limit stop engaging the attaching clips and precluding movements of the cage with respect to the helmet.

(4) In a further aspect, in an effort to enhance the effectiveness of the chin bar, two general improvements have been made in its structure. In a first aspect, instead of fastening the chin bar to the helmet on each side using a one point fastener, the present invention contemplates fastening the chin bar to the helmet at two points on each side of the shell. Through such fastening means, the chin bar is less likely to wobble with respect to the shell, and this extends the life of the chin bar and the helmet. In a further aspect, the shell is molded with recessed portions designed to receive the two portions of the chin bar on each side thereof where they will be fastened to the shell. In this way, the outer surfaces of the chin bar are flush or co-planar with the shell surfaces at the locations of attachment to provide a smooth transition therebetween so that the chin bar may be slightly narrower and therefore lighter in weight.

(5) In a further aspect, the inventive helmet contemplates providing an adjustment means to adjust the fit of the helmet to the user that will facilitate the ability of the user to make adjustments to the fit of the helmet in the field. The present invention contemplates a star wheel on each side of the helmet which is attached to an arcuate strip or band of plastic or other flexible material that loops rearwardly around the occipital area of the skull to the rear of the user's head. A star wheel comprising locking means is provided on each side of the shell and each side also includes a gripping means comprising a sliding mechanism or slider attached to the strip that allows the strip to be moved forward and backward to allow it to be tightened and loosened, respectively, with respect to the player's head. In this way, the locking means comprising star wheels can be loosened, the sliders employed to tighten or loosen the helmet, and then the star wheels tightened to fix the fit of the helmet as desired.

(6) An alternative lateral adjustment device is also contemplated by the present invention. In this regard, a molded piece includes a plurality of parallelograms, the dimensions of which may be varied through movements of one set of walls thereof with respect to a second set of walls. Using this principle, with such a device installed in a helmet, reciprocation of one set of walls with respect to the other expands the parallelograms to tighten the fit of the helmet, whereas movement in the other direction collapses the parallelograms to loosen the fit of the helmet.

Accordingly, it is a first object of the present invention to provide an improved sport helmet.

It is a further object of the present invention to provide such a helmet with enhanced padding to reduce the possibility of injury from point impacts on the outer shell.

It is a further object of the present invention to provide such a sport helmet with enhanced attachment means for the face guard or cage thereof that will result in weight reduction.

It is a still further object of the present invention to provide such a sport helmet including a chin guard with two point attachments on each side to prevent wobbling of the chin guard.

It is a still further object of the present invention to provide such a sport helmet with a chin bar with attachment points flush with the shell to reduce weight.

It is a yet further object of the present invention to provide such a sport helmet with a limit stop precluding or drastically reducing movements of the cage with respect to the shell.

It is a yet further object of the present invention to provide such a sport helmet including adjustment means for the fit of the helmet including a flexible strip located around the occipital portion of the skull of the user and adjustment means usable not only at the point of purchase but in the field.

It is a still further object of the present invention to provide a sport helmet including a further embodiment of adjustment means for the fit of the helmet including the use of a plurality of parallelograms, the dimensions of which may be controllably adjusted to facilitate adjustment of the fit.

These and other objects, aspects and features of the present invention will be better understood from the following detailed description of the preferred embodiments when read in conjunction with the appended drawing figures.

SPECIFIC DESCRIPTION OF THE EMBODIMENTS

Figure 1:
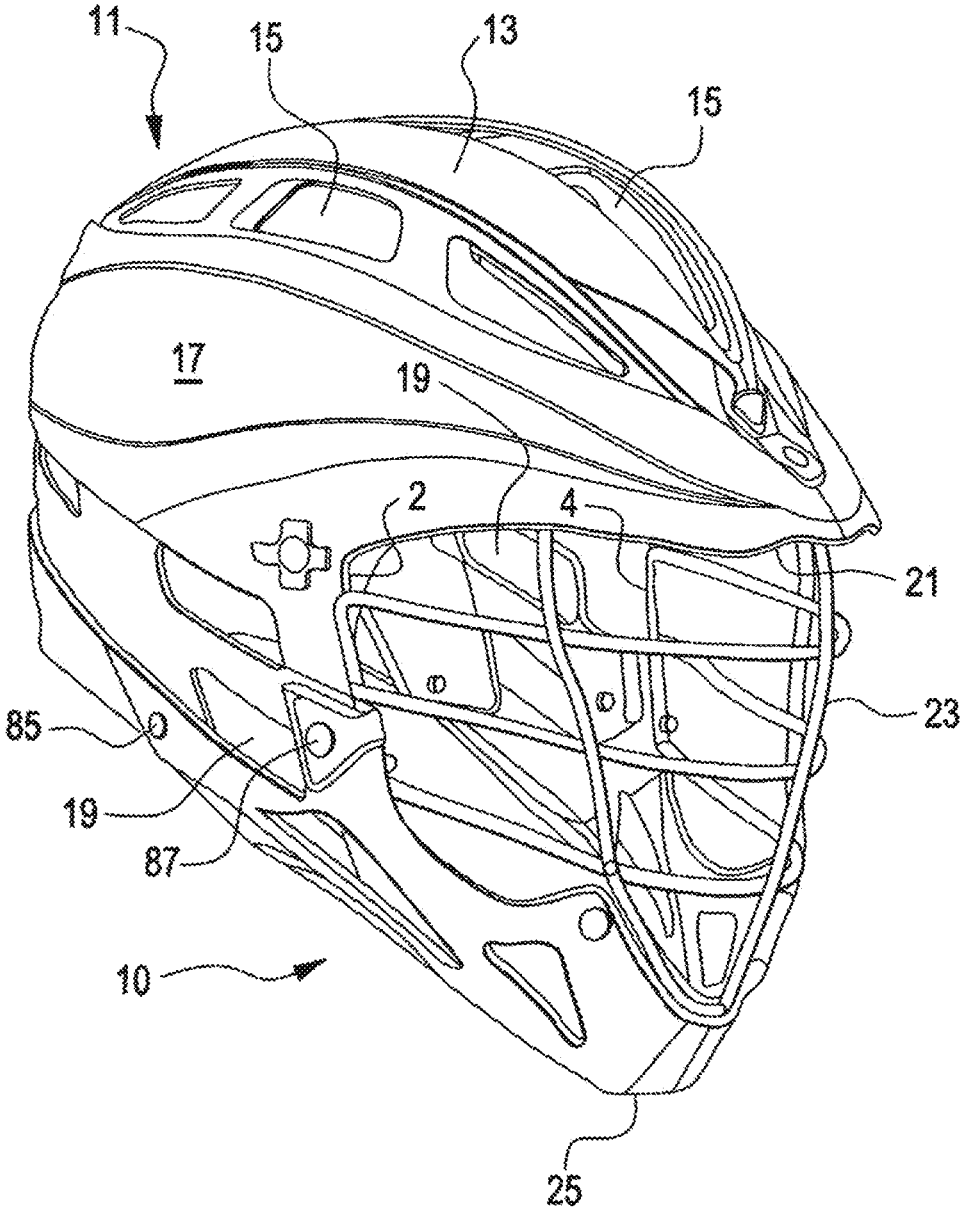
FIG. 1 shows a perspective view of a preferred embodiment of the helmet in accordance with the teachings of the present invention.

With reference first to FIGS. 1-9, the inventive sport helmet is generally designated by the reference numeral 10 and is seen to include a shell 11 having a crown portion 13, vent openings 15, side portions such as the side portion 17 seen in FIG. 1, ear holes 19, a front ledge 21, a face guard 23 consisting of a cage, and a chin guard 25.

Figure 14:
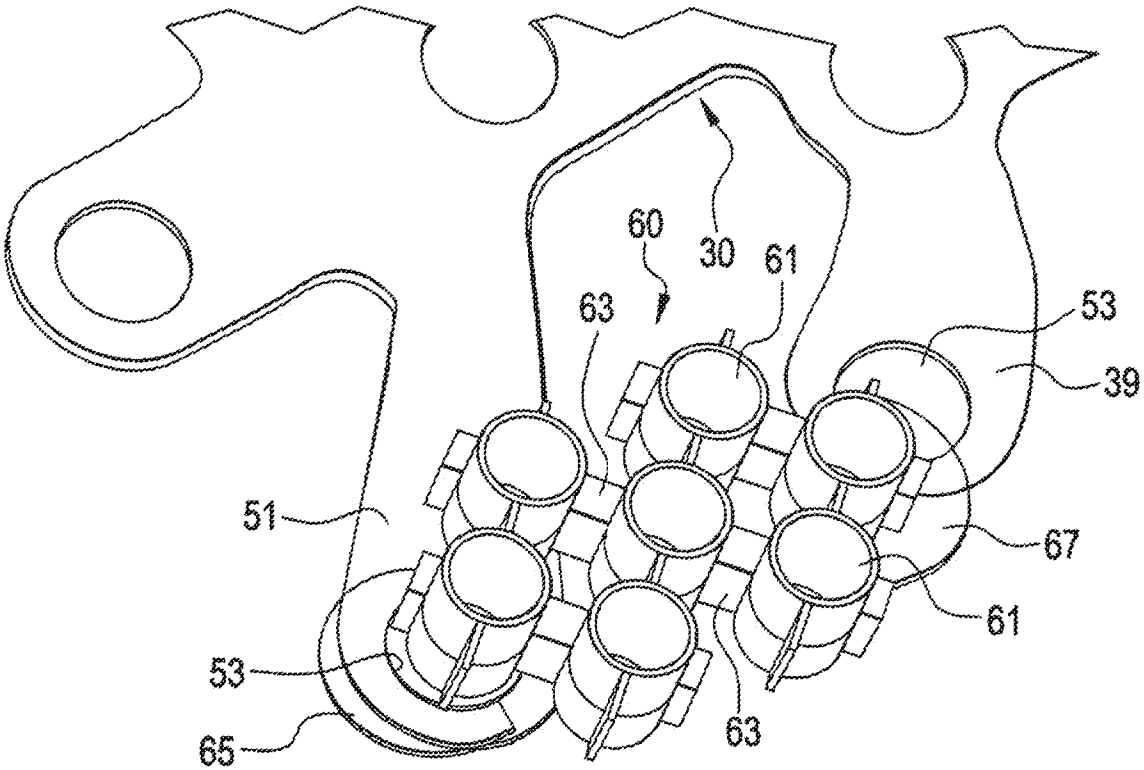
FIG. 14 shows a portion of the armature and one set of tubes enlarged to show detail.

With reference to FIGS. 12-14 and 16, the helmet 10 includes an inner surface of the shell 12 in which is mounted protective padding. In this regard, with reference to FIG. 13, an armature 30 is made of a thin flexible material and includes a plurality of branches or appendages, for example, 31, 33, 35, 37, 39, 41, 43, 45, 47, 49 and 51. Each of these branches or appendages includes one or more openings 53 for a purpose to be described in greater detail hereinafter. With reference to FIG. 14, a portion of the armature 30 is shown and is seen to releasably receive a modular cushioning device comprising a lateral displacement shock absorbing material 60 including a plurality of parallel tubes 61 held together by webbing 63. The tubes 61 are preferably configured in the manner particularly shown in FIGS. 1, 2 and 4 of Applicants' Assignee's prior U.S. patent application Ser. No. 11/229,626, filed on Sep. 20, 2005, and for which a published patent application was published on Apr. 19, 2007, and assigned Publication No. US2007/0083965 A1.

As seen in FIG. 14, the shock absorbing material includes a pair of tabs 65 and 67. As best understood from FIG. 14, a tab 65 is inserted through an opening 53 in the armature on each end of the material 60 to hold the material 60 in the position shown in FIG. 14 and in the positions shown in FIG. 13. The openings to which each cushioning device 60 is attached may be on separate respective branches or on the same branch. The material components 60 are installed on the armature 30 initially before the armature 30 and components 60 are installed in the helmet 10. Initially, the armature 30 lies flat. However, the pairs of holes 53 are spaced apart a slightly greater distance than the spacing between pairs of tabs 65, 67. As such, when the tabs 65, 67 are inserted into respective holes 53, the armature 30 adopts an arcuate configuration resembling the shape of the inner surfaces of the helmet 10 shell 11 into which it will be mounted.

These sets of seven tubes, each comprising a lateral displacement shock absorbing material, are specifically located on the armature 30 such that when the armature 30 is installed within the inner surface 12 of the shell 11 of the helmet 10, they are located in positions of vulnerability for the skull of the user so that those areas of vulnerability are best protected. This is seen with particular reference to FIG. 12 which shows the armature 30 with a plurality of sets of lateral displacement shock absorbing material 60 mounted within the inner surface 12 of the shell 11 of the helmet 10. In the preferred embodiment, a thin layer of padding covers the armature 30 and the sets of shock absorbing material 60 to hide them from visibility while assisting in spreading forces imposed on the skull of the user as a result of impacts to be expected through playing a game such as lacrosse or hockey. The advantage of the use of the armature 30 is that the lateral displacement shock absorbing material made in sets of seven tubes as shown may be arranged on a flat surface for ease of assembly and then the entire armature unit with the shock absorbing material so installed may easily be attached inside the inner surface of the shell 11 of the helmet 10. The tabs 65 and 67, best seen in FIG. 14, facilitate ease of assembly and retention in assembled configuration.

Each cushioning member 60 may comprise from 1 to 10 or more tubes held in parallel relation (where more than one tube is included) by webbing. Alternatively, the cushioning member may comprise any desired cushion or padding mountable on the armature.

As disclosed in Published Application No. US2007/0083965 A1, in the preferred embodiment of the lateral displacement shock absorbing material 60, the material is made of any suitable material such as thermoplastic, for example, polypropylene urethanes and rubber, and may be made in an injection molding process in a pressure molding process by casting, drape molding or machining.

Figure 4:
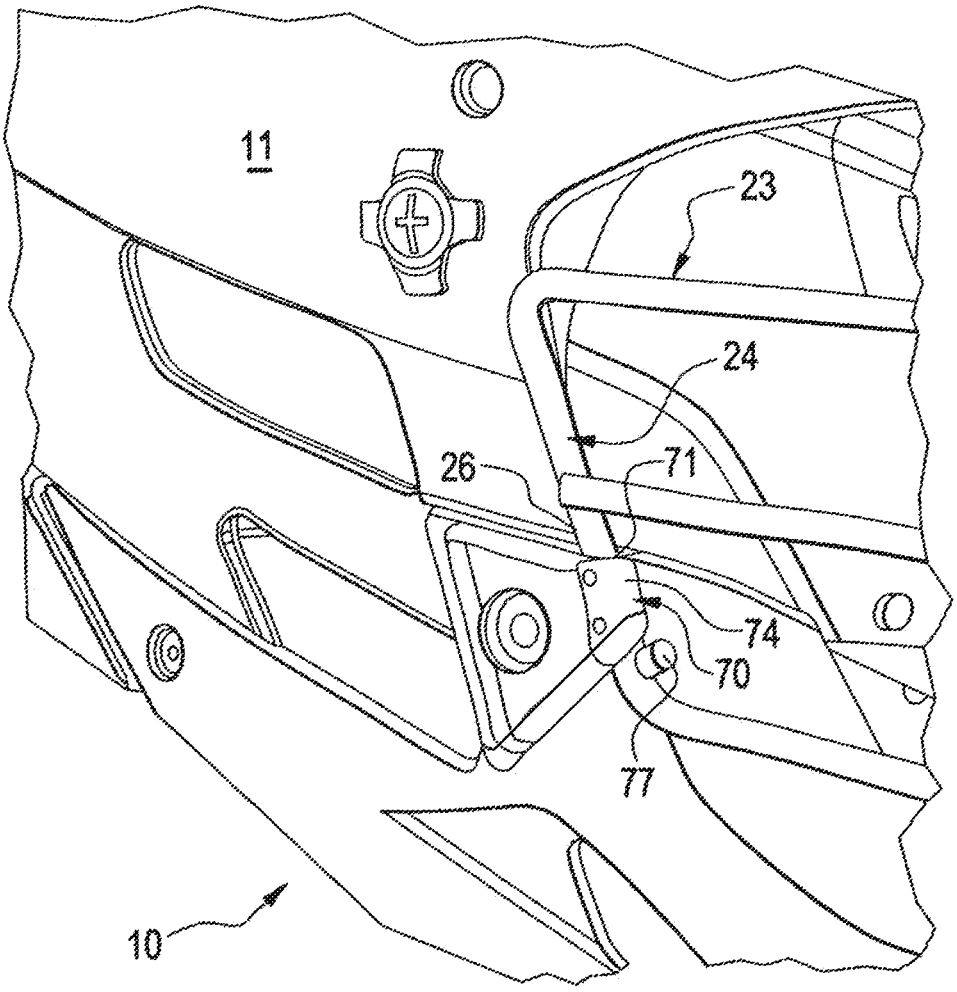
FIG. 4 shows a view similar to that of FIG. 3, but enlarged to show particular details.

As disclosed in Applicants' Assignee's prior Published Application No. US2007/0083965 A1, the side walls of the tubes 61 may be configured as best seen, for example, in FIG. 4 of the Published Application including use of double tapers, inside tapers, outside tapers or any combination thereof as applicable to the particular situation encountered. These configurations result in a softer initial resistance followed by an increase in crush resistance as the material is compressed so that it exhibits a somewhat uniform resistance throughout a wide range of crushing activity.

Figure 2:
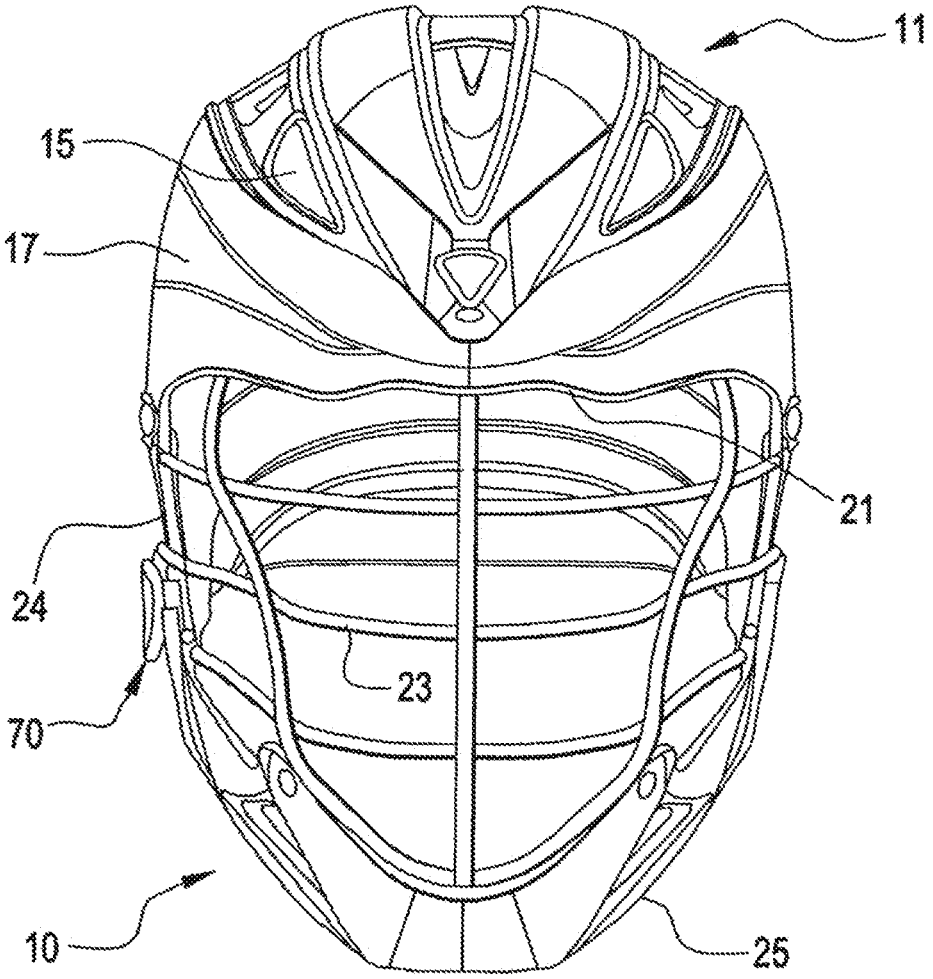
FIG. 2 shows a front view of the inventive helmet.
Figure 10:
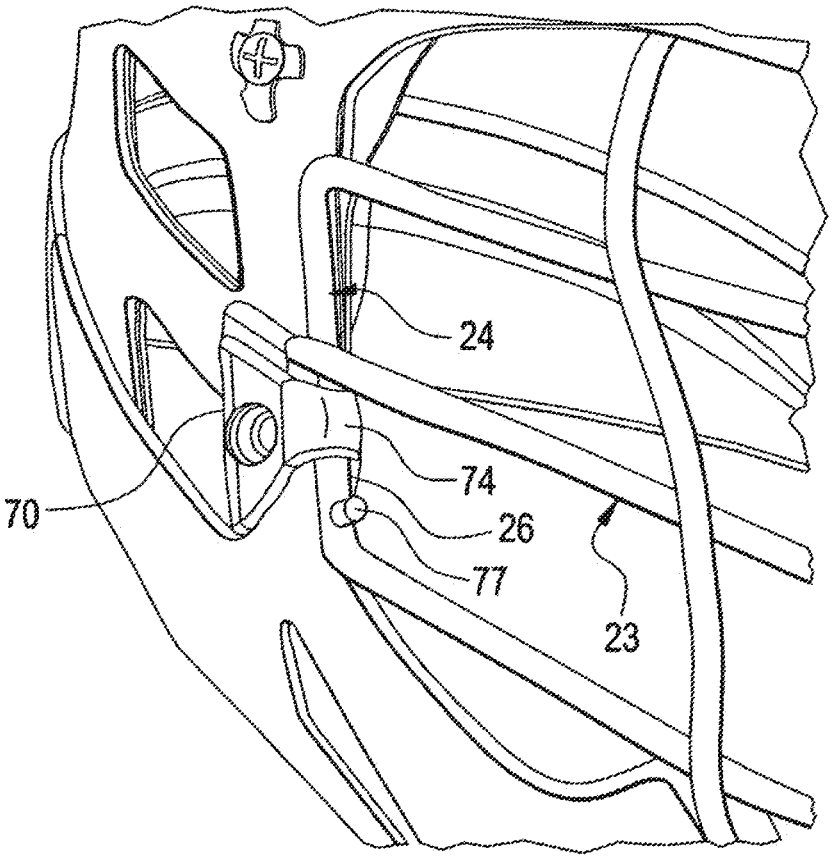
FIG. 10 shows a perspective view from the front and right side of the inventive helmet.
Figure 11:
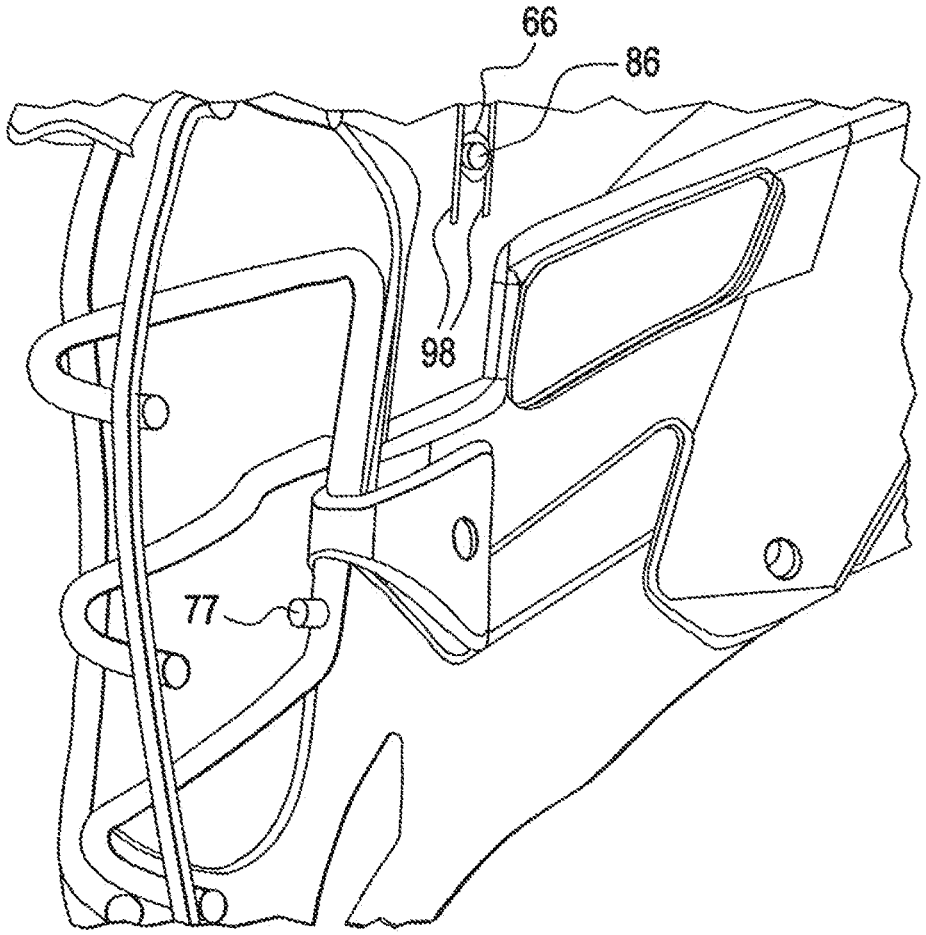
FIG. 11 shows a further side perspective view showing the inside of the shell with portions removed to show detail.
Figure 12:
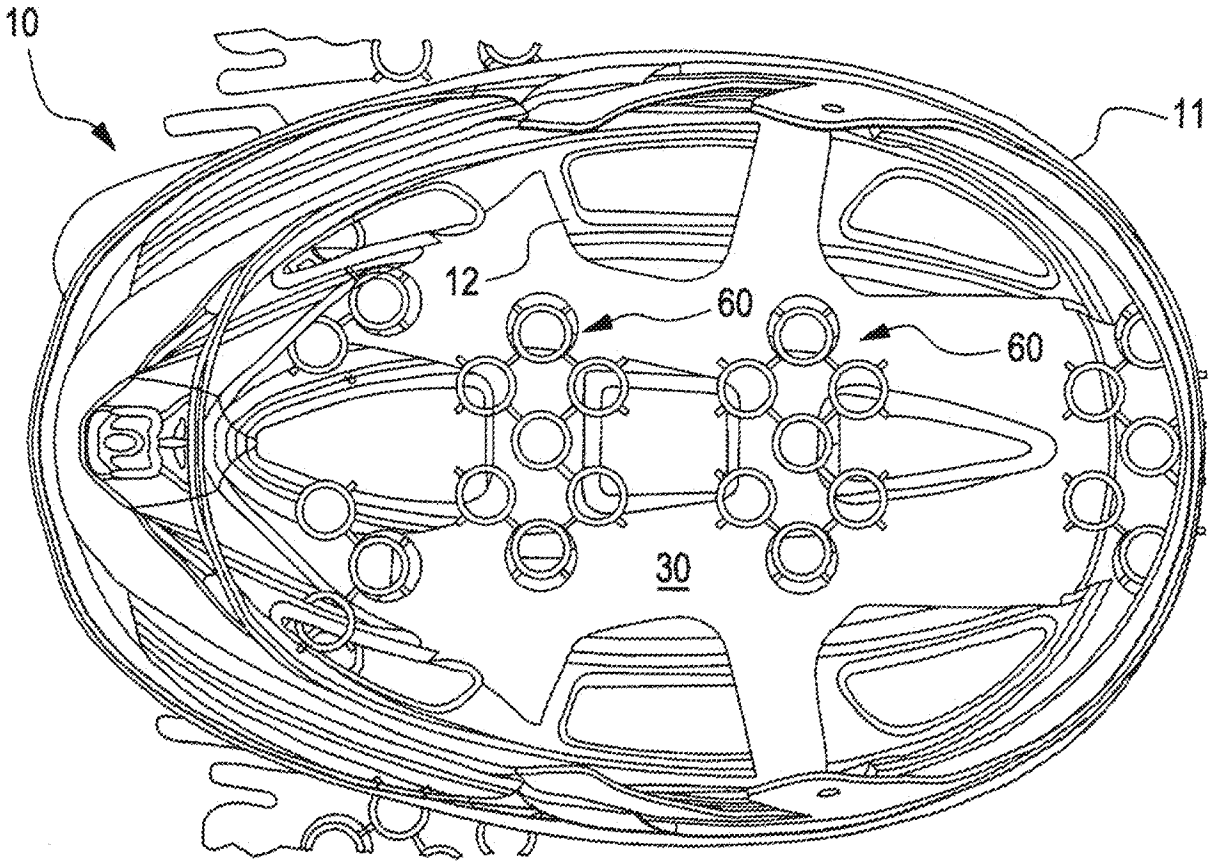
FIG. 12 shows a bottom view of the present invention showing the location of mounting of an armature and padding structures.
Figure 13:
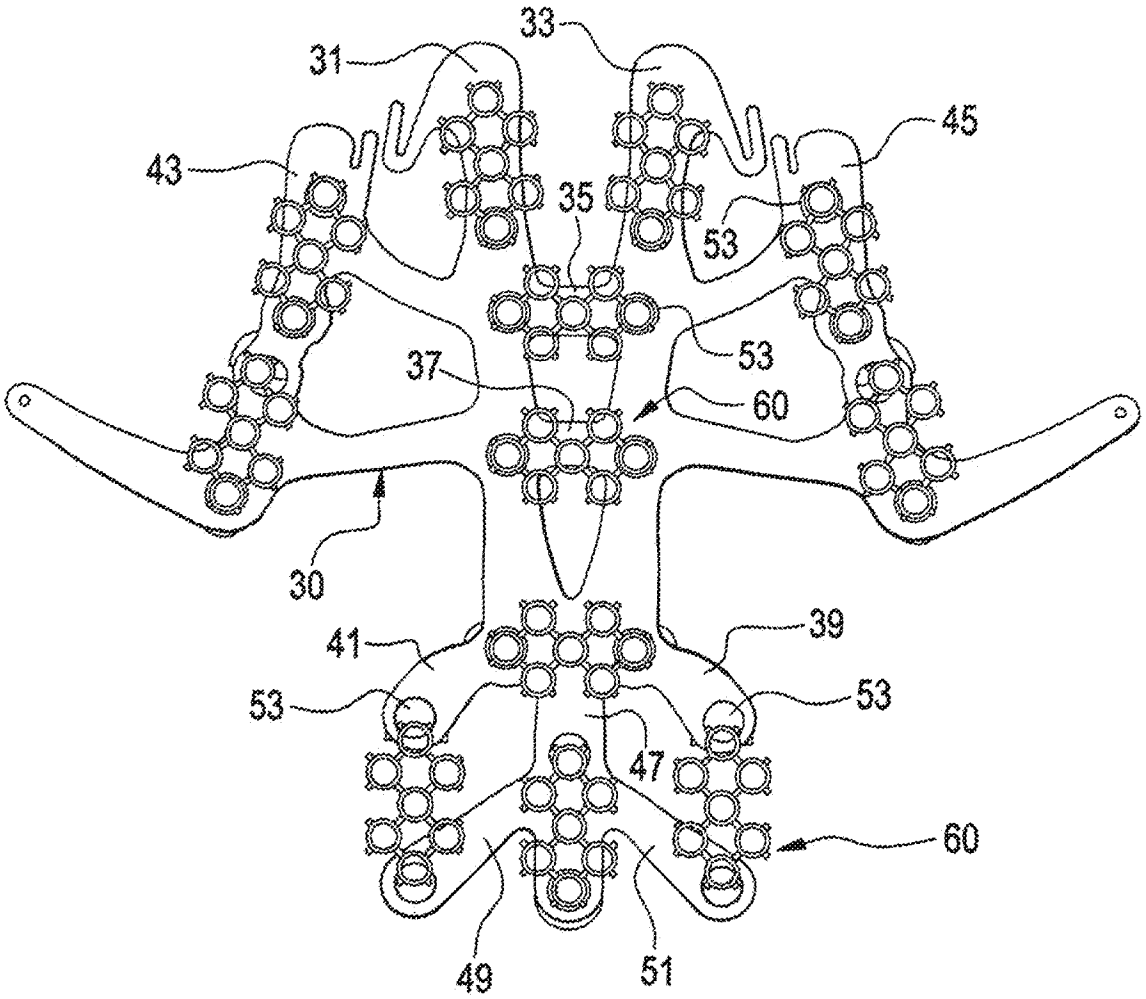
FIG. 13 shows the armature and padding structures of FIG. 12 separate from the helmet.

With reference now to FIGS. 2, 4 and 10, the manner of mounting of the face guard or cage 23 to the shell 11 will now be described. As seen in FIG. 1, the shell has front edges 2 and 4 connected by ledge 21. With particular reference to FIG. 4, it is seen that the cage 23 includes a plurality of vertical and horizontal bars crossing one another including a generally vertical bar 24 that extends from the top to the bottom thereof. At one portion 26 of the cage 23, it is captured by a clip 70 which is seen to include an internal opening 71 which captures the portion 26 of the bar 24. However, with reference to FIG. 2, it is seen that the clip 70 extends both on the outside of the shell 11, engaging an outer surface thereof, and on the inside thereof, engaging an inner surface thereof, so that the bar 24, as best seen in FIG. 2, lies against the shell in assembly. This is to be contrasted with the prior art, as explained above, in which a P-shaped clip encloses the cage and is entirely on the outside of the helmet so that a side bar of the cage is spaced from the side surface of the shell by one-half the thickness of the P-shaped clip. Thus, by virtue of the teachings of the present invention, the cage 23 may be made slightly narrower and thus slightly lighter in weight because it does not have to be spaced from the shell by P-shaped clips that are not used in accordance with the teachings of the present invention. This is also seen with reference to FIG. 10. A suitable fastener extends through openings on the inner and outer halves of the clip 70 to hold the clip in place.

Figure 3:
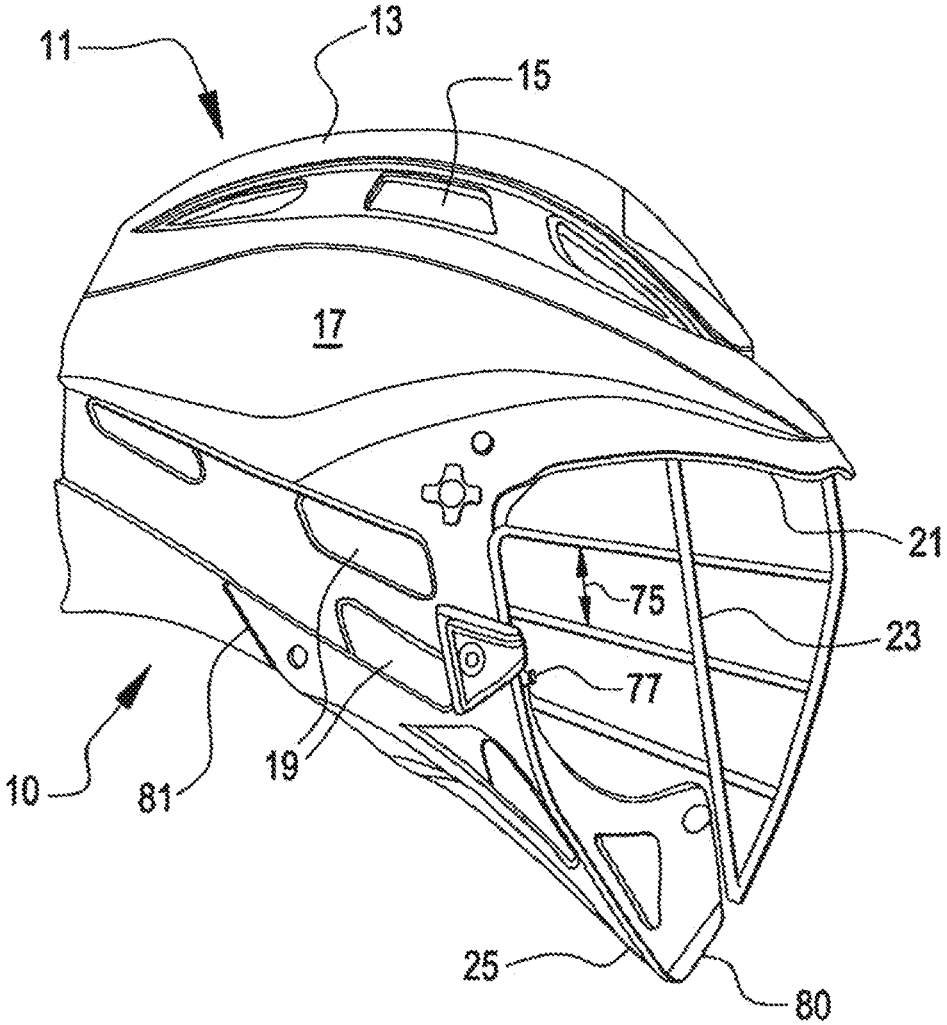
FIG. 3 shows a side view of the inventive helmet.

With further reference to FIGS. 3, 4 and 10, in particular, it should be understood that the cage 23 may typically slide up and down in the directions of the arrow of the double-headed arrow 75 shown in FIG. 3. It is advantageous to preclude such movement from taking place because such movement cannot only harm the user, but can also cause premature wear and destruction of the helmet 10. In order to preclude such movement, as seen in these figures, a knob 77 is fastened to the bar portion 26 in any suitable manner such as, for example, by welding in the case of a metal knob 77 and a metal cage 23. With such a knob 77 in place, the knob 77 acts as a limit stop, limiting upward movement of the cage 23 with respect to the shell to only an extremely small distance, whereupon the knob 77 engages a portion 74 of the clip (FIGS. 4 and 10) to limit upward movement of the cage 23 with respect to the shell 11. The knob may be spherical, cylindrical or any other desired shape.

Figure 5:
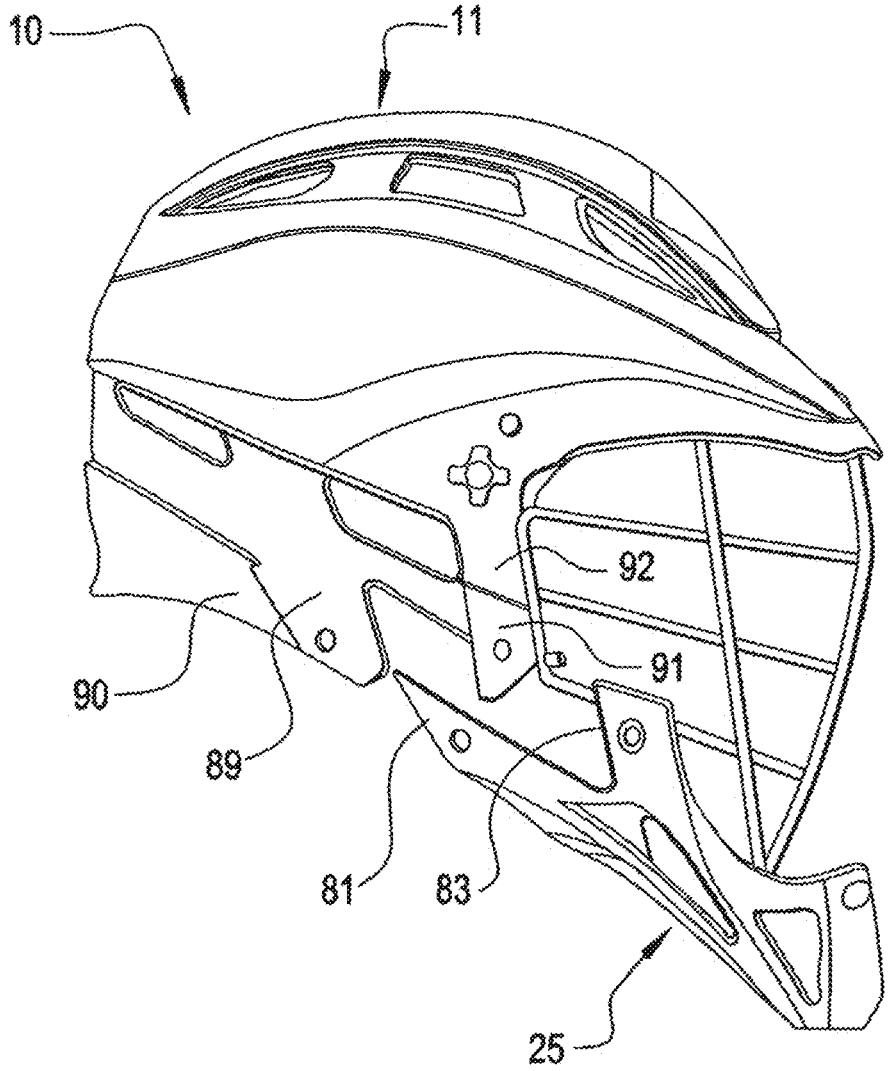
FIG. 5 shows a view similar to that of FIG. 3, but with structures separated from one another to show details.
Figure 6:
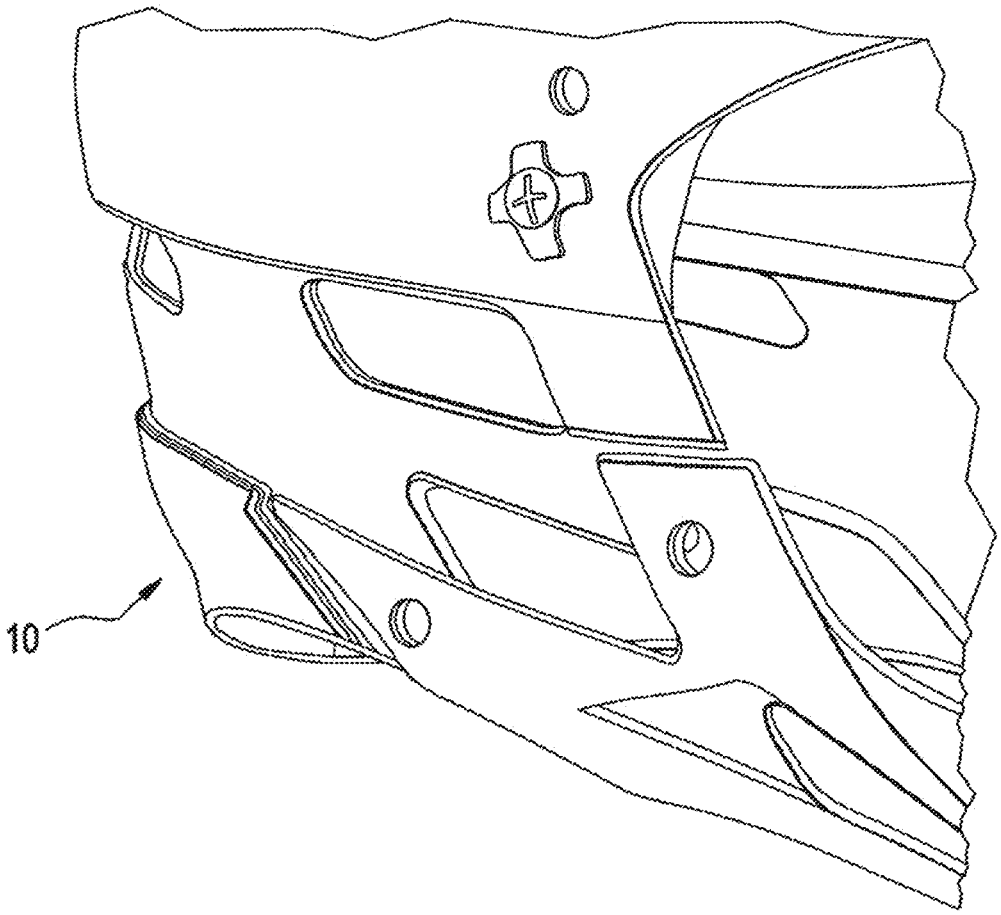
FIG. 6 shows a view similar to that of FIGS. 3 and 5 with portions removed to show details.
Figure 7:
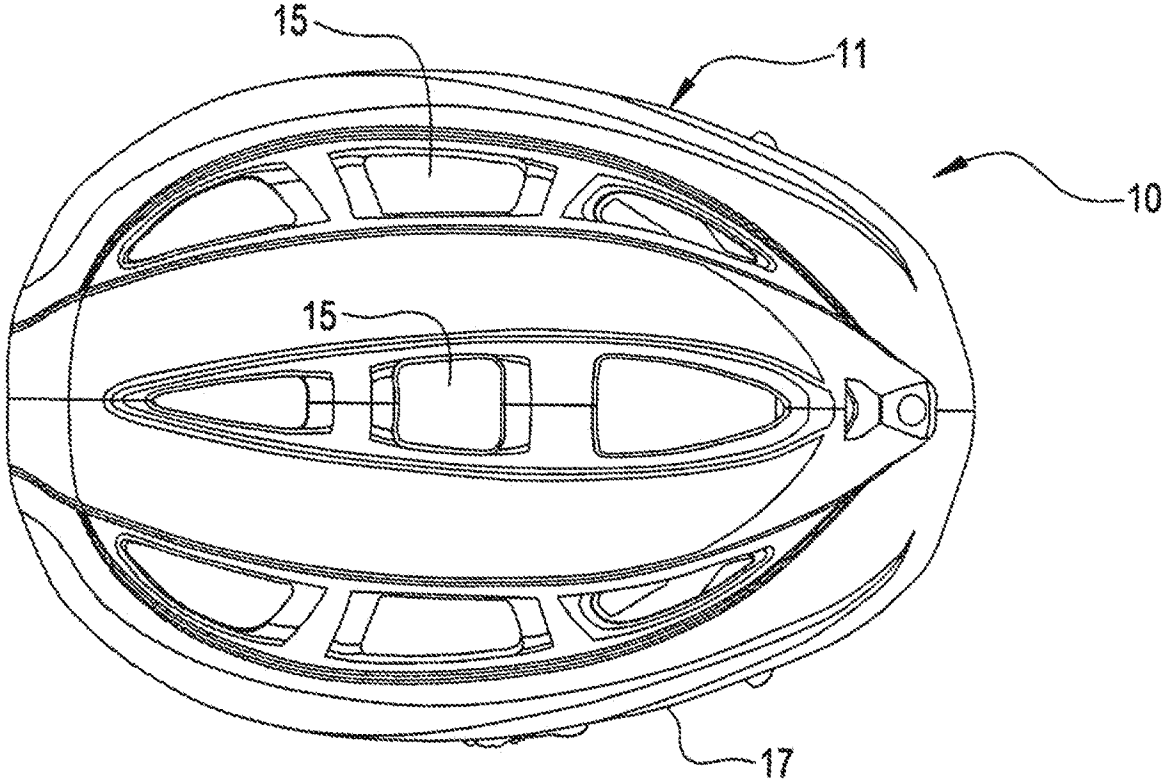
FIG. 7 shows a top view of the inventive helmet.
Figure 8:
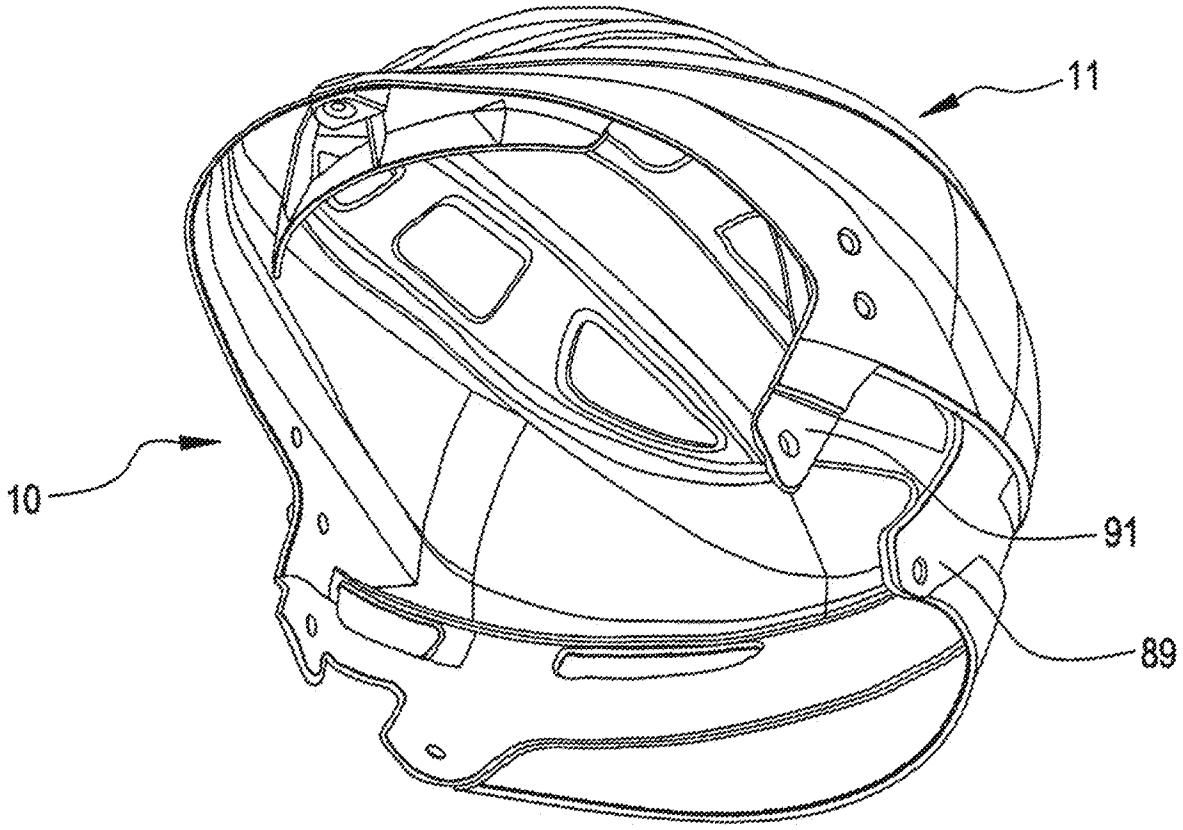
FIG. 8 shows a perspective view from the side and beneath the inventive helmet.
Figure 9:
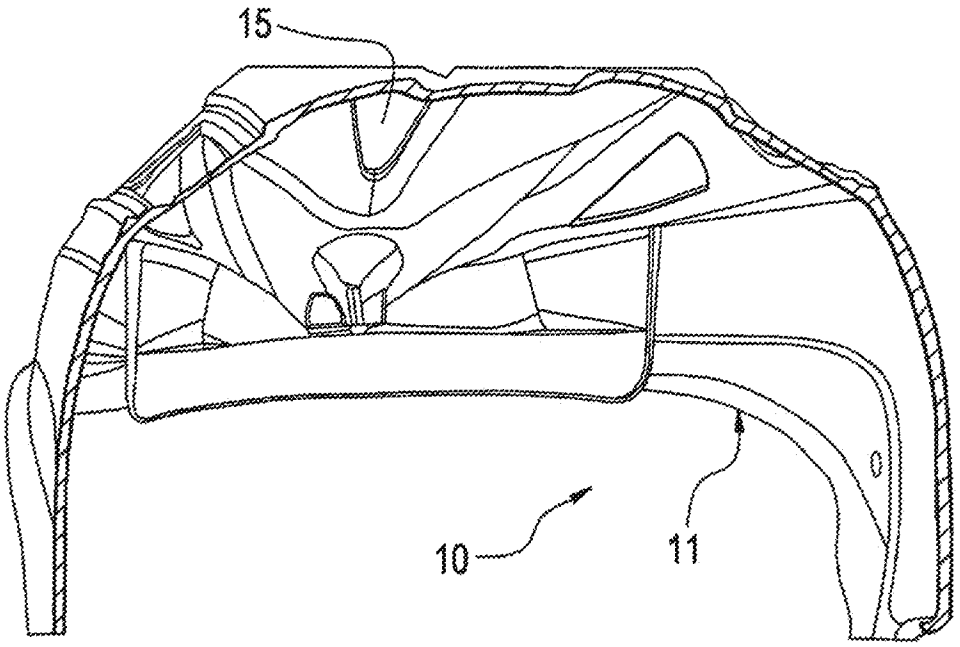
FIG. 9 shows a view looking rearwardly into the inventive helmet with portions removed to show detail.

With reference now to FIGS. 3, 4 and 5, in particular, improvements in the shell 11 and chin bar 25 will be better understood. With reference first to FIG. 3, the chin bar 25 is seen to include a chin guarding portion 80 and, on the right side of the helmet, two attachment members or branches 81 and 83. The left side of the chin bar 25 is symmetric with the right side, thus, each side of the chin bar has two attachment points or branches for attachment of the chin bar to the helmet. This is seen in greater detail with reference to FIG. 2.

With reference to FIGS. 1 and 3, it is seen that the attachment point or branch 81 is attached to the helmet through the use of a fastener 85, while a fastener 87 is used to attach the second attachment point or branch 83 to the helmet. As best seen in FIG. 5, the shell 11 is molded to provide a thin area 89 and another thin area 91. The areas 90 and 92 adjacent the areas 89 and 91, respectively, are thicker with the difference in thickness being equal to the thickness of the chin guard 25. Thus, when the chin bar 25 is installed on the shell 11 as seen in FIG. 1, the branches 81 and 83 have outer surfaces that are coplanar with the surfaces 90 and 92 of the shell. Thus, there is a smooth transition between the branches 81 and 83 of the chin bar 25 and the shell 11 at the surfaces 90 and 92, respectively. This smooth transition is in stark contrast with the structures of prior art helmets in which the chin guards, where used, are to attached on top of the shell, but with no recesses, thus causing the sides of the chin guard to outwardly protrude from the surfaces of the shell.

As should be understood, the fact that the branches 81 and 83 are located in recessed portions on the shell 11 causes the chin bar 25 to be able to be made slightly narrower than is the case with prior art chin guards. This slightly reduces the amount of material employed in manufacturing the chin bar 25 and therefore reduces the weight of the helmet slightly.

Figure 19:
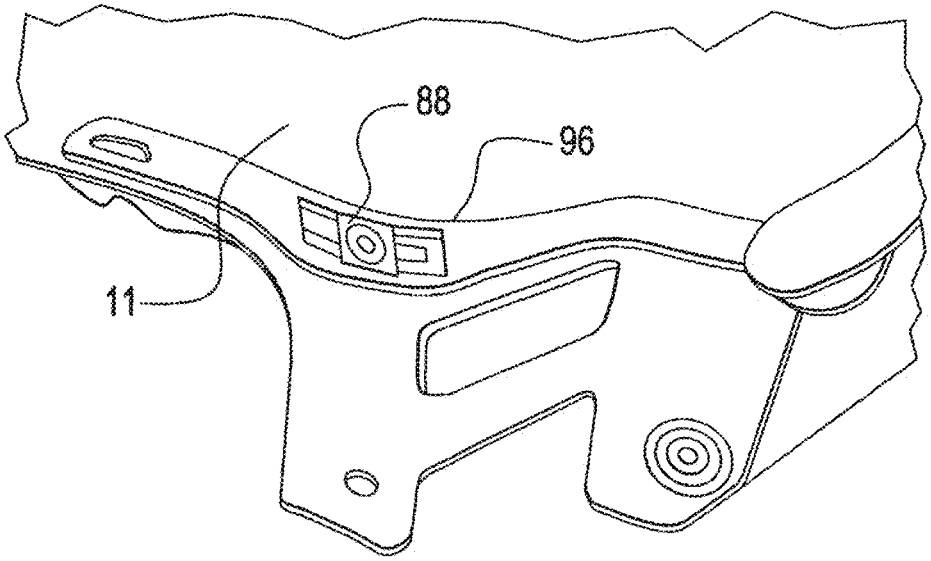
FIG. 19 shows details of the structure permitting the occipital fit adjusting means to be locked in a desired configuration.

With reference now to FIGS. 11 and 15-19, a description will be add of an important aspect of the present invention concerning means permitting adjustment of the fit of the helmet to the user. With reference first to FIG. 15-19, it is seen on the right side of the helmet that a star wheel 82 has a central opening 84 through which a fastener 86 extends. With reference to FIG. 19, a threaded T-nut 88 threadably receives the fastener 86 so that rotation of the star wheel 82 in one direction tightens the fastener 86 within the T-nut 88 and rotation of the star wheel 82 in the opposite direction loosens the connection. In the preferred embodiment, clockwise rotation of the star wheel tightens the connection, whereas counterclockwise rotation loosens the connection.

Figure 15:
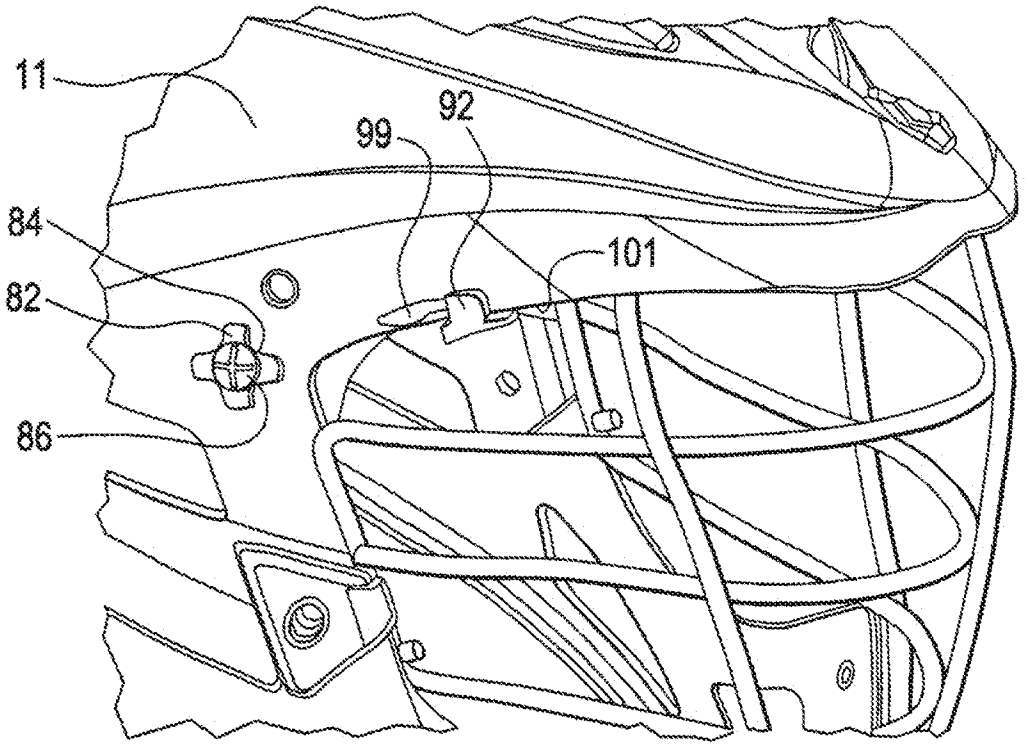
FIG. 15 shows an enlarged side perspective view showing details of a variety of the inventive features of the inventive helmet.
Figure 16:
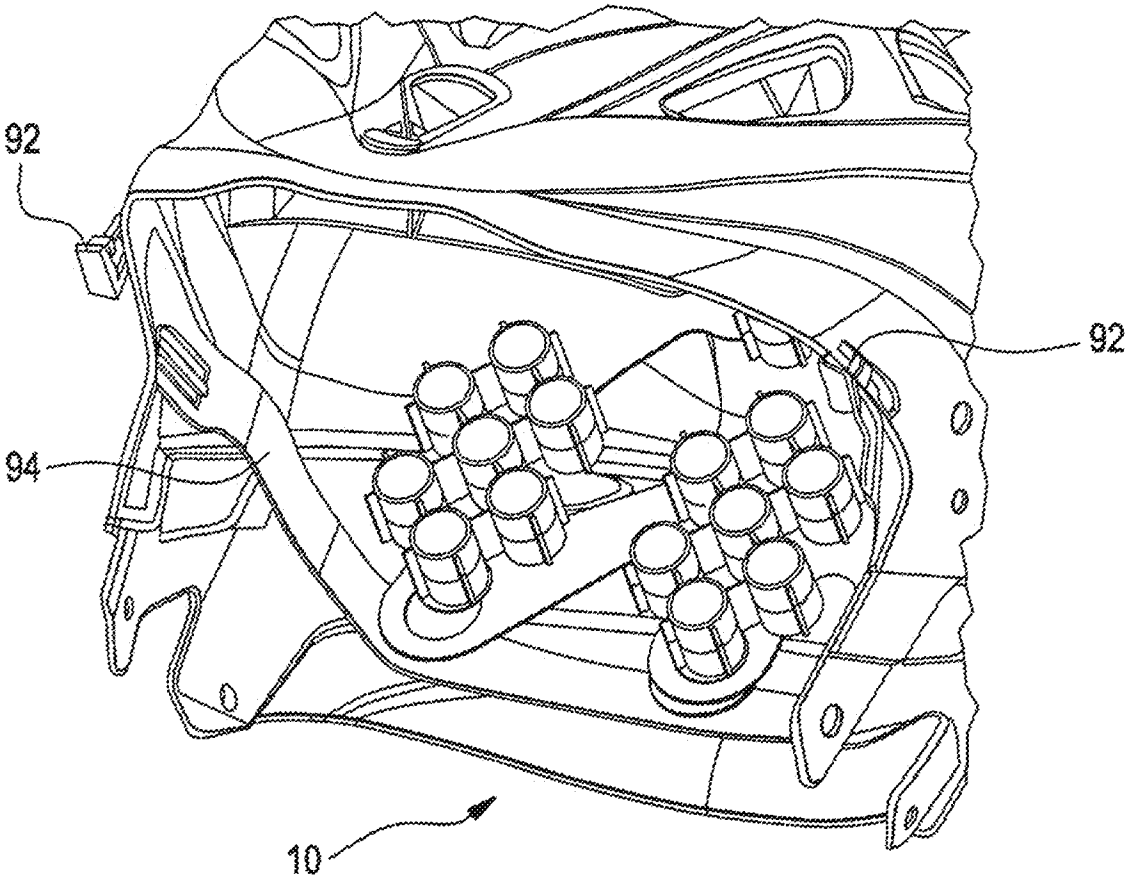
FIG. 16 shows a further perspective view with details of the occipital fit adjusting means shown.
Figure 17:
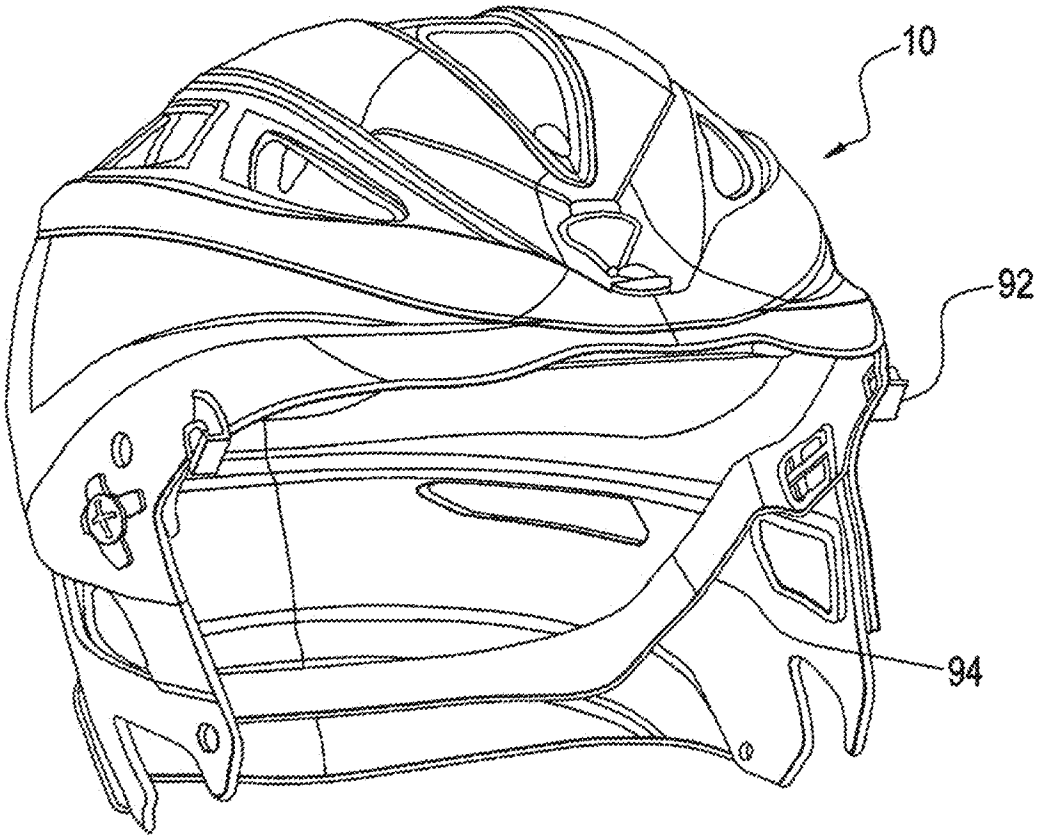
FIG. 17 shows a front right side perspective view with portions removed to show details of the occipital fit adjusting means.
Figure 18:
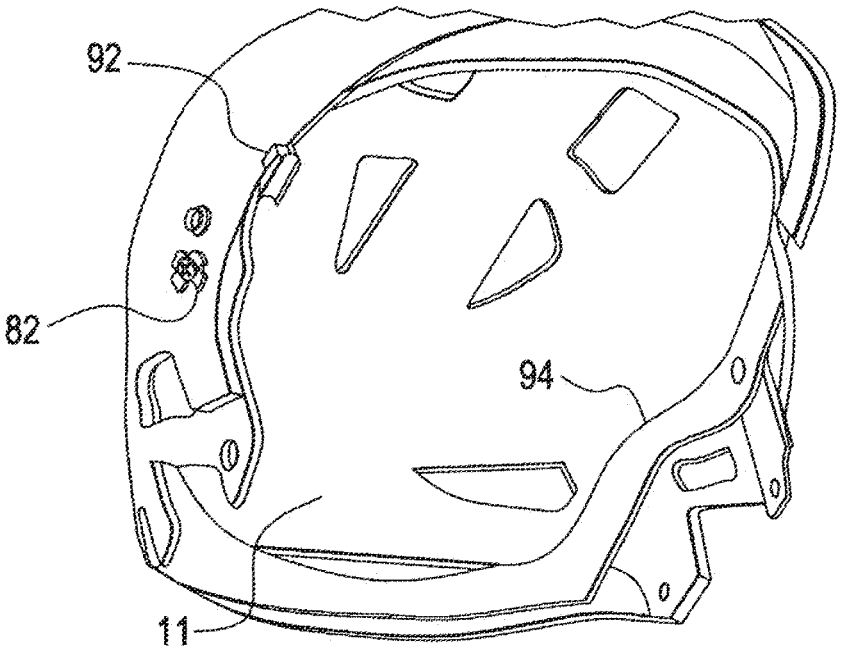
FIG. 18 shows further details of the occipital fit adjusting means.

Also shown in FIG. 15 is a slider 95 provided for a purpose to be described in greater detail hereinafter. As best seen in FIG. 17, the slider 95 is integrally connected to a flexible band 94 that extends around the rear of the helmet at a location corresponding to the occipital portion of the skull of the user when the user is wearing the helmet 10. A slider 95 is provided on each side of the helmet at each end of the band 94 and each of the sliders 95 has a gripping portion 97 that is accessible by the user from outside the shell 11 as best seen with reference to FIGS. 15 to 18 FIG. 16. As best seen in FIG. 19, the T-nut 88 is mounted within a slot 96 formed in the band 94. The T-nut 88 is fixed in position within the shell 11 since its distance end extends into the opening 84 within the star wheel 82. Thus, as should be understood, the ends of the band 94 may be slid through engagement of the sliders 95 so that the band 94 may laterally move with respect to the T-nuts 88 by virtue of the grooves 96. In the view of FIG. 16, wherein this movement should be understood to cause the band 94 to shorten and thereby tighten the band 94 about the head of the user when the sliders 95 are slid forward in the view of FIG. 15. Similarly and wherein oppositely, when the sliders 92 are slid rearwardly in the view of FIG. 15, the band 94 is loosened, thereby allowing it to accommodate to the dimensions of a larger skull. Thus, with particular reference to FIGS. 15, 16, 17, 18 and 19, it should be understood that by turning the star wheels 82 on each side of the helmet counterclockwise, the connection between the fasteners 86 and the T-nuts 88 is loosened, thereby permitting the user to access the gripping portion 97 of each sliders 92 slider 95 and slide to be slid forward or backward each slider 95 in the view of FIG. 15 to tighten or loosen, respectively, the band 94 about the head of the user. Once the band is moved to the position most comfortable and secure for the user, the star wheels 82 are rotated clockwise to tighten the connection between the fasteners 86 and T-nuts 88 to lock the position of the band 94 about the occipital region of the skull of the user. In this way, the user may easily adjust and re- adjust the fit of the helmet 10 on their head.

In accordance with the teachings of the present invention, the fastener 86 may have a coupling portion of any desired type such as a phillips head, hexagonal recess, or any other desired tool coupling. Furthermore, with reference in particular to FIG. 11, a pair of ribs 98 are located to either side of the fastener 86 and the opening 66 into which the T-nut is inserted. These ribs are provided so that when the T-nut is tightened, they act to help lock the position of the band 94 in a fixed position. It is also noted, with reference to FIGS. 16 and 18 FIG. 15, that the slider 95 has a slider portion which is slid in a slot 99 so that it is properly guided and the slider 95 is retained in position along the edge 101 of the shell 11.

The band 94 may be made of any desired material such as, for example, soft plastic or leather. The cage 23 is preferably made of metal bars welded together, but could also be made of another material such as hard plastic, KEVLAR, carbon fiber and the like. The chin bar 25 is preferably molded out of hard plastic, but could also be made of a lightweight metal such as, for example, aluminum. The shell 11 is preferably made of molded plastic.

Figure 20:
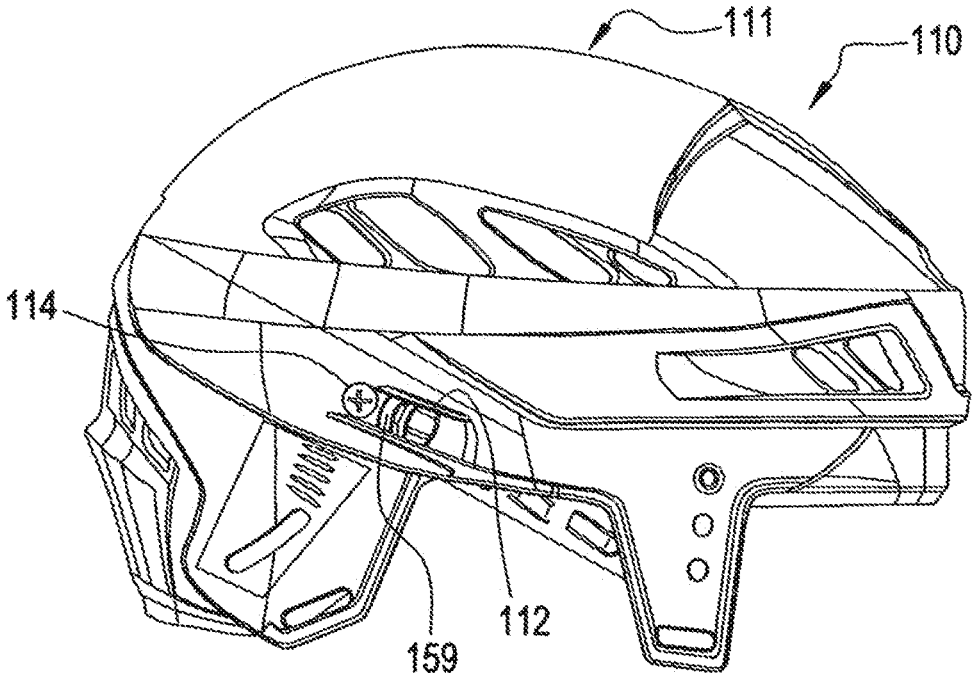
FIG. 20 shows a perspective view of a sport helmet including a further embodiment of a fit adjusting means.
Figure 21:
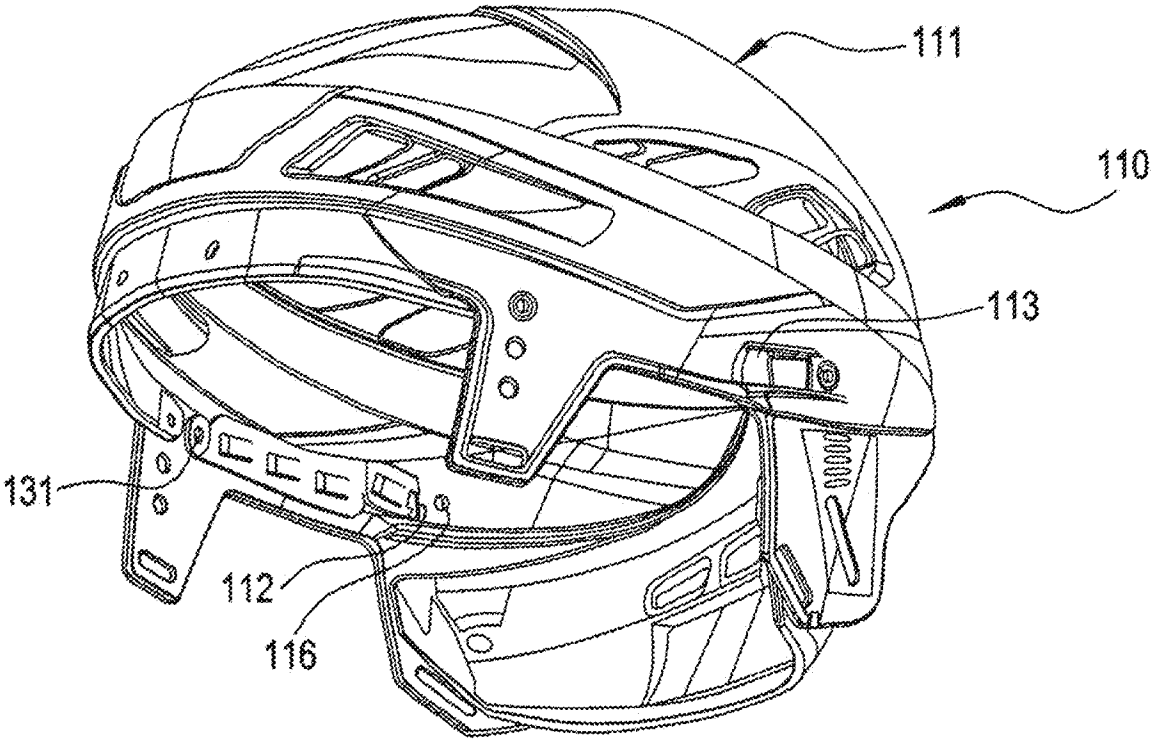
FIG. 21 shows a further perspective view of the helmet of FIG. 20 showing the inside of the helmet and the manner of mounting of a portion of the fit adjusting means.

With reference now to FIGS. 20-25, a further aspect of the present invention will now be described consisting of a lateral adjustment means for a sport helmet. With reference first to FIGS. 20 and 21, a sport helmet is generally designated by the reference numeral 110 and is seen to include a hard shell 111. As shown in FIGS. 20 and 21, rectangular openings 112 and 113 are provided on opposed sides of the helmet for a purpose to be described in greater detail hereinafter.

With reference now to FIGS. 22-25, a lateral adjustment device is generally described by the reference numeral 120 and is seen to include a parallelogram portion 121 and a separate leg 123.

With further reference to FIGS. 22-25, the parallelogram portion 121 includes two legs, a first leg 125 and a second leg 127. The first leg 125 terminates at an end 129 having an opening 131 designed to receive, for example, a threaded fastener intended to fix the end 129 within the helmet 110. The opening 131 is also seen in FIG. 21. The second leg 127 terminates at an adjustment mechanism or ratchet mechanism 133 to which is connected the third leg 123 which terminates distally of the parallelogram portion 121 at an end 135 having an opening 137. The opening is provided to facilitate fixation of the end 135 in the helmet by virtue of a fastener such as the fastener 114 seen in FIG. 20. The fastener 114 extends through an opening 116 in the helmet 110 as seen in FIG. 21.

Figure 22:
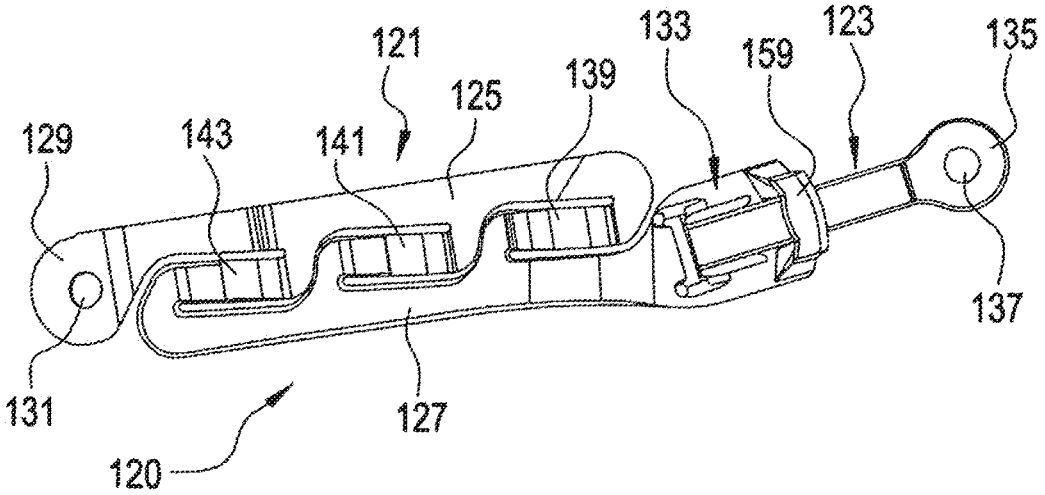
FIG. 22 shows a side view of a preferred construction of the fit adjusting means of FIGS. 20 and 21.
Figure 23:
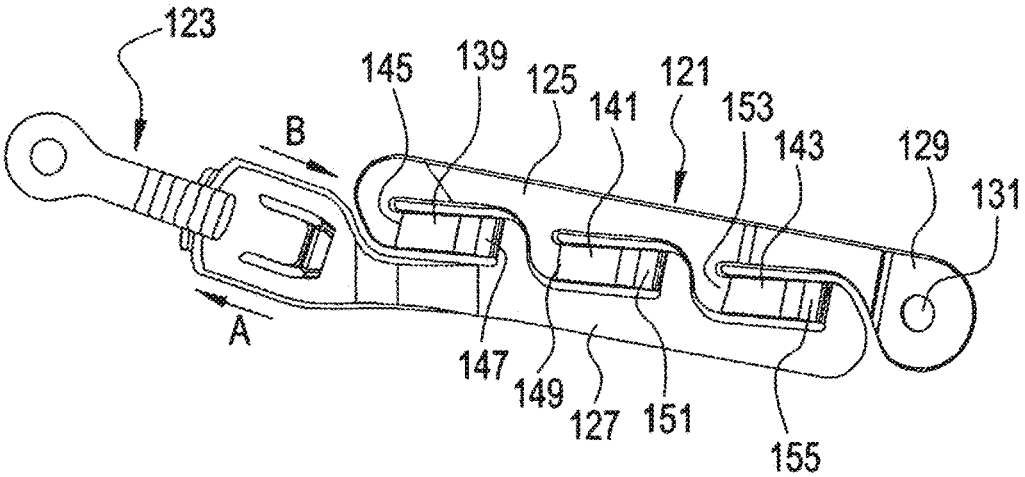
FIG. 23 shows a further side view of the fit adjusting means from a side opposite to that which is shown in FIG. 22.

With particular reference to FIGS. 22 and 23, the parallelograms are defined by the legs 125 and 127 as well as by the additional legs 139, 141 and 143, also described as connecting leg portions. As seen in FIGS. 22 and 23, the leg 139 has a first end 145 connected to the leg 125, and a second end 147 connected to the leg 127. The leg 141 has a first end 149 connected to the leg 125, and a second end 151 connected to the leg 127. The leg 143 has a first end 153 connected to the leg 125, and a second end 155 connected to the leg 127.

Figure 24:
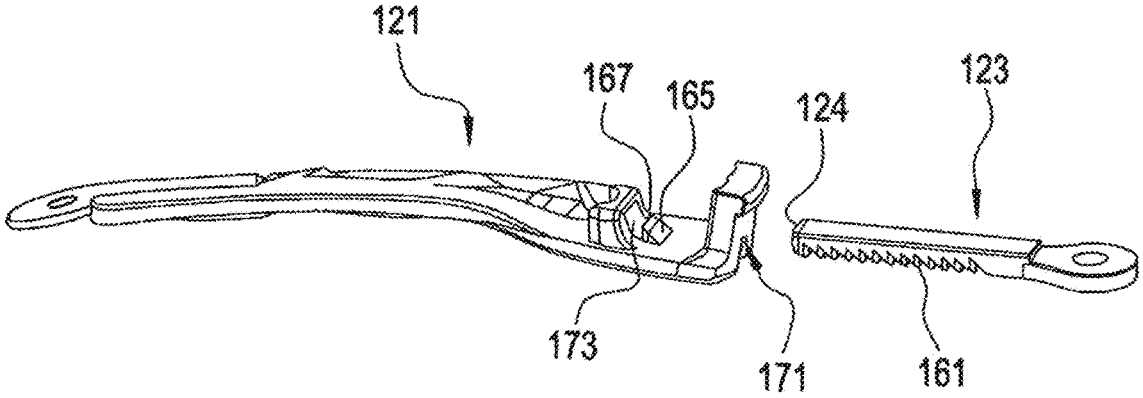
FIG. 24 shows an exploded edge view of the inventive fit adjusting means.
Figure 26:
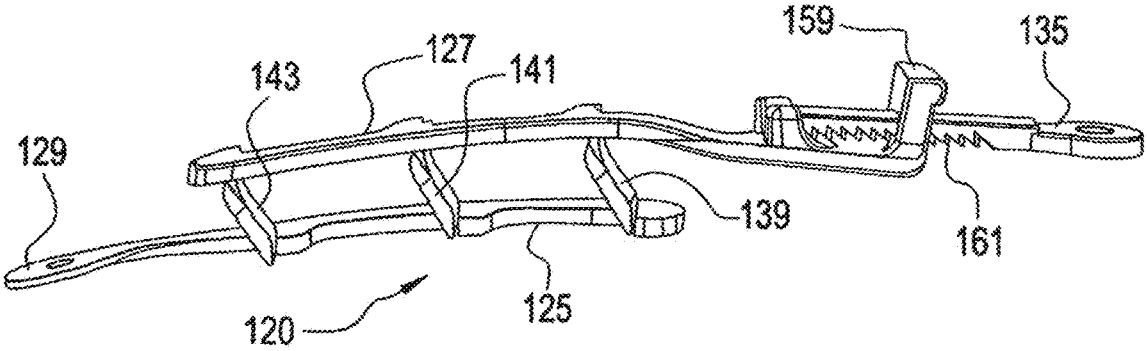
FIG. 26 shows a view from a similar perspective to that of FIGS. 24 and 25, but with the legs of the parallelogram vertically spaced through operation of the device.

As should be understood with reference, for example, to FIG. 23, with the end 129 of the leg 125 made immovable through the use of a fastener (not shown) extending through the opening 131, and with the leg 127 reciprocated in the direction of the arrow A, movements of the leg 127 with respect to the leg 125 causes pivoting at the respective ends of the legs 139, 141 and 143 to thereby cause the leg 127 to lift up with respect to the leg 125 from a position at which the legs 125 and 127 are substantially co-planar to a position at which they are vertically spaced from one another in substantially parallel planes, thereby increasing the thickness of the device 120 in the direction of the dimension "X" as shown in FIG. 24. This configuration of the device 120 is also seen in FIG. 26.

Figure 25:
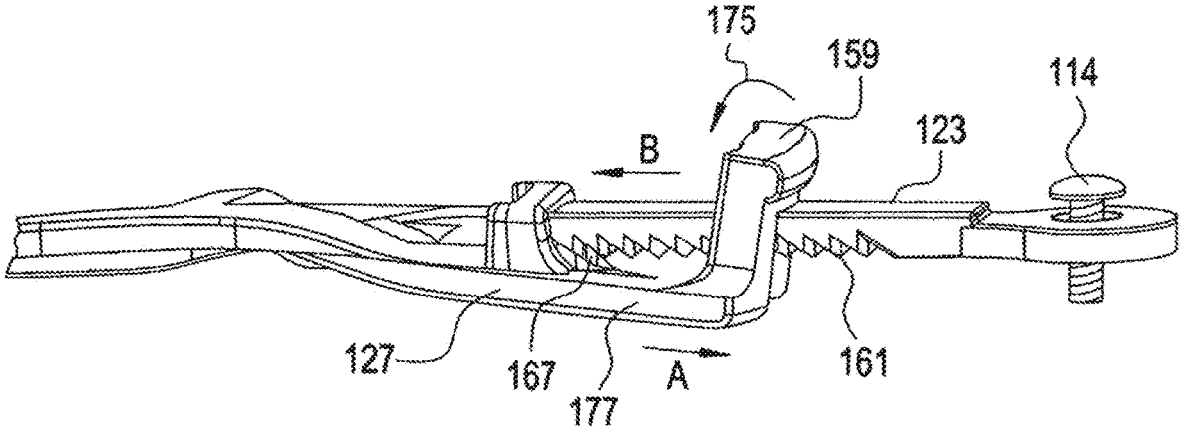
FIG. 25 shows a view similar to that of FIG. 24, but enlarged and with the parts assembled to show the manner of operation.

In order to facilitate use of the inventive lateral adjustment device in the sport helmet 110, the leg 127 includes an actuating tab 159 (FIGS. 22 and 25) that is seen in FIG. 20 extending through the slot 112 in the helmet 110. The leg 123 includes a plurality of teeth 161 best seen in FIGS. 24 and 25. With reference to FIGS. 24 and 25, the leg 127 includes a flexible pivoting member 165 on which a tooth 167 is provided that is sized and configured to enter any one of the teeth 161 on the leg 123. As should be understood from FIG. 25, the directional arrow A corresponds to the directional arrow A in FIG. 23. With the leg 123 fixed in position in the helmet 110 by virtue of the fastener 114 (FIGS. 20 and 25), movements of the leg 127 in the direction of the arrow A will cause successive ones of the teeth 161 to ride up on the tooth 167 and move past it with the configurations of the teeth 161 and the tooth 167 precluding reverse movement in the direction of the arrow B. As such movements occur, with the leg 125 also fixed by virtue of a fastener (not shown) extending through the opening 131 and fastened to the helmet 110, the connecting leg portions 139, 141 and 143 will pivot toward the position shown in FIG. 26 to expand the thickness of the device 120 in the direction X shown in FIG. 24. In this way, the device 120 will tighten the fit of the helmet about the head of the user.

As also evident from FIGS. 24 and 25, in particular, the leg 123 has an end 124 that extends through an opening 171 of the leg 127 to one side of the tooth 167, and another opening 173 on the leg 127 at an opposite side of the tooth 167.

With the device 120 moved to the position shown in FIG. 26, it may subsequently be desirable to facilitate collapse of the parallelograms back toward the configuration shown, for example, in FIG. 24. In order to do so, reference is made to FIG. 25. When such collapse is desired, the user may pivot the tab 159 in the direction of the arrow 175. Such pivoting causes the leg 127 to bend at approximately the location of the lead line extending from the reference numeral 177. With the leg 123 captured within the openings 171 and 173 and being relatively rigid as compared to the leg 127, this pivoting motion of the tab 175 and bending of the leg 127 causes the tooth 167 engaging the tooth 161 to lift off from the tooth 167, thereby permitting movement of the leg 127 in the direction of arrow B (FIG. 25), to thereby facilitate collapse of the parallelograms.

In the preferred embodiment of the lateral adjustment device 120, the components thereof are made of a suitable molded plastic. In the preferred embodiment of the present invention, two devices 120 are provided, one on each side of the helmet 110.

The present invention has been disclosed in terms of its applicability as a sport helmet for players in the games of lacrosse and hockey. While these are preferred environments of contemplated use, the teachings of the present invention are also applicable in other environments and applications. These include in motor sports such as motorcycle riding and in driving of automobiles and other vehicles; animal riding activities such as horseback riding, rodeo riding, polo playing; water activities such as swift water boating, knee boarding, kite boarding, sailing, surfing, wind surfing; construction, safety and occupational helmets such as hard hats, firefighter helmets, riot helmets, law enforcement helmets; aviation helmets such as those used in skydiving and by smoke jumpers, airplane pilots and airplane crew members, military and otherwise; rescue helmets such as those used in swift water rescue, and those used in confined spaces; snow activity helmets such as those used in skiing, snowboarding, sledding, sliding, snowmobiling; military helmets such as ballistic helmets and those used by soldiers; climbing and caving helmets; pole vaulting helmets; non-motorized wheeled activity helmets such as those used in cycling, inline skating, and skateboarding; medical helmets; martial arts helmets; and helmets used in other sports such as football, baseball, softball, boxing, and others.

Accordingly, an invention has been disclosed in terms of preferred embodiments thereof which fulfill each and every one of the objects of the invention as set forth hereinabove, and provide a new and useful improved sport helmet of great novelty and utility.

Of course, various changes, modifications and alterations in the teachings of the present invention may be contemplated by those of ordinary skill in the art without departing from the intended spirit and scope thereof.

As such, it is intended that the present invention only be limited by the terms of the appended claims.

The invention claimed is:

1. A helmet for protecting a wearer's head, the helmet comprising:

a protective shell including a left side portion with a left front edge, and a right side portion with a right front edge, the left side portion comprising a left side outer surface including first and second left side recessed portions recessed into the left side outer surface of the protective shell, and the right side portion comprising a right side outer surface including first and second right side recessed portions recessed into the right side outer surface of the protective shell;

a chin bar fastenable to the shell to extend forward of the left and right front edges, the chin bar including a left side and a right side, the left side of the chin bar including first and second left side branches, and the right side of the chin bar including first and second right side branches, wherein the first recessed portion of the left side outer surface of the shell is configured to receive the first branch of the left side of the chin bar, the second recessed portion of the left side outer surface is configured to receive the second branch of the left side of the chin bar, the first recessed portion of the right side outer surface of the shell is configured to receive the first branch of the right side of the chin bar, and the second recessed portion of the right side outer surface of the shell is configured to receive the second branch of the right side of the chin bar; and a face guard mountable to the shell and configured to protect the wearer's face;

wherein the face guard comprises a wire cage.

2. A helmet as in claim 1, wherein the first left side branch extends from the chin bar to a first branch end on the left side portion of the shell, the second left side branch extends from the chin bar to a second branch end on the left side portion of the shell, the first right side branch extends from the chin bar to a third branch end on the right side portion of the shell, and the second right side branch extends from the chin bar to a fourth branch end on the right side portion of the shell.

3. A helmet as in claim 1, wherein the chin bar is fastened to a lower portion of the face guard.

4. A helmet as in claim 1, wherein the chin bar is made of plastic and the face guard is made of metal.

5. A helmet as in claim 1, wherein the face guard has a bottom edge, and the chin bar includes a top edge positioned opposed to the bottom edge of the face guard.

6. A helmet as in claim 1, wherein each of the first and second left side recessed portions is molded into the protective shell, and each of the first and second right side recessed portions is molded into the protective shell.

7. A helmet for protecting a wearer's head, the helmet comprising:

a protective shell including a left side portion with a left front edge, and a right side portion with a right front edge, the left side portion comprising a left side outer surface including a first left side recessed portion recessed into the left side outer surface of the protective shell, and the right side portion comprising a right side outer surface including a first right side recessed portion recessed into the right side outer surface of the protective shell;

a chin bar made of hard plastic, the chin bar being fastenable to the shell to extend forward of the left and right front edges, the chin bar including a left side and a right side, the left side of the chin bar including a first left side branch, and the right side of the chin bar including a first right side branch, wherein the first recessed portion of the left side outer surface of the shell is configured to receive the first branch of the left side of the chin bar, and the first recessed portion of the right side outer surface of the shell is configured to receive the first branch of the right side of the chin bar; and a face guard made of metal and mountable to the shell and configured to protect the wearer's face.

8. A helmet as in claim 7, wherein:

the left side outer surface further comprises a second left side recessed portion;

the right side outer surface further comprises a second right side recessed portion;

the left side of the chin bar includes a second left side branch;

the right side of the chin bar includes a second right side branch;

the second recessed portion of the left side outer surface of the shell is configured to receive the second branch of the left side of the chin bar; and the second recessed portion of the right side outer surface of the shell is configured to receive the second branch of the right side of the chin bar.

9. A helmet as in claim 8, wherein the first left side branch extends from the chin bar to a first branch end on the left side portion of the shell, the second left side branch extends from the chin bar to a second branch end on the left side portion of the shell, the first right side branch extends from the chin bar to a third branch end on the right side portion of the shell, and the second right side branch extends from the chin bar to a fourth branch end on the right side portion of the shell.

10. A helmet as in claim 7, wherein the chin bar is fastened to a lower portion of the face guard.

11. A helmet as in claim 7, wherein the first left side recessed portion is molded into the protective shell, and the first right side recessed portion is molded into the protective shell.

12. A helmet for protecting a wearer's head, the helmet comprising:

a protective shell including a left side portion with a left front edge, and a right side portion with a right front edge, the left side portion comprising a left side outer surface including a first left side recessed portion molded into the protective shell, and the right side portion comprising a right side outer surface including a first right side recessed portion molded into the protective shell;

a face guard mountable to the shell and configured to protect the wearer's face, the face guard having a bottom edge; and a chin bar fastenable to the shell to extend forward of the left and right front edges, the chin bar including a top edge positioned opposed to the bottom edge of the face guard, the chin bar further including a left side and a right side, the left side of the chin bar including a first left side branch, and the right side of the chin bar including a first right side branch, wherein the first recessed portion of the left side outer surface of the shell is configured to receive the first branch of the left side of the chin bar, and the first recessed portion of the right side outer surface of the shell is configured to receive the first branch of the right side of the chin bar;

wherein the chin bar is made of plastic and the face guard is made of metal.

13. A helmet as in claim 12, wherein:

the left side outer surface further comprises a second left side recessed portion;

the right side outer surface further comprises a second right side recessed portion;

the left side of the chin bar includes a second left side branch;

the right side of the chin bar includes a second right side branch;

the second recessed portion of the left side outer surface of the shell is configured to receive the second branch of the left side of the chin bar; and the second recessed portion of the right side outer surface of the shell is configured to receive the second branch of the right side of the chin bar.

14. A helmet as in claim 13, wherein the first left side branch extends from the chin bar to a first branch end on the left side portion of the shell, the second left side branch extends from the chin bar to a second branch end on the left side portion of the shell, the first right side branch extends from the chin bar to a third branch end on the right side portion of the shell, and the second right side branch extends from the chin bar to a fourth branch end on the right side portion of the shell.

15. A helmet as in claim 12, wherein the chin bar is fastened to a lower portion of the face guard.

16. A helmet as in claim 12, wherein the face guard comprises a wire cage.

17. A helmet for protecting a wearer's head, the helmet comprising:

a protective shell including a left side portion with a left front edge, and a right side portion with a right front edge, the left side portion comprising a left side outer surface including a first left side recessed portion recessed into the left side outer surface of the protective shell, and the right side portion comprising a right side outer surface including a first right side recessed portion recessed into the right side outer surface of the protective shell;

a chin bar, the chin bar being fastenable to the shell to extend forward of the left and right front edges, the chin bar including a left side and a right side, the left side of the chin bar including a first left side branch, and the right side of the chin bar including a first right side branch, wherein the first recessed portion of the left side surface of the shell is configured to receive the first branch of the left side of the chin bar, the first recessed portion of the right side surface of the shell is configured to receive the first branch of the right side of the chin bar; and a face guard mountable to the shell and configured to protect the wearer's face, the face guard having a left lateral side that overlies a portion of the shell left side portion that is not recessed, and the face guard further having a right lateral side that overlies a portion of the shell right side portion that is not recessed; wherein:

the left side outer surface further comprises a second left side recessed portion recessed into the left side outer surface of the protective shell;

the right side outer surface further comprises a second right side recessed portion recessed into the right side outer surface of the protective shell;

the left side of the chin bar includes a second left side branch;

the right side of the chin bar includes a second right side branch;

the second recessed portion of the left side surface of the shell is configured to receive the second branch of the left side of the chin bar;

the second recessed portion of the right side surface of the shell is configured to receive the second branch of the right side of the chin bar; and the first left side branch extends from the chin bar to a first branch end on the left side portion of the shell, the second left side branch extends from the chin bar to a second branch end on the left side portion of the shell, the first right side branch extends from the chin bar to a third branch end on the right side portion of the shell, and the second right side branch extends from the chin bar to a fourth branch end on the right side portion of the shell.

18. A helmet as in claim 17, wherein the chin bar is fastened to a lower portion of the face guard.

19. A helmet as in claim 17, wherein the chin bar is made of plastic and the face guard is made of metal.

20. A helmet as in claim 17, wherein the face guard has a bottom edge, and the chin bar includes a top edge positioned opposed to the bottom edge of the face guard.

21. A helmet as in claim 17, wherein the face guard comprises a wire cage.

22. A helmet for protecting a wearer's head, the helmet comprising:

a protective shell including a left side portion with a left front edge, and a right side portion with a right front edge, the left side portion comprising a left side outer surface including first and second left side recessed portions, each of the first and second left side recessed portions being recessed into the left side outer surface of the protective shell, and the right side portion comprising a right side outer surface including first and second right side recessed portions, each of the first and second right side recessed portions being recessed into the right side outer surface of the protective shell;

a chin bar fastenable to the shell to extend forward of the left and right front edges, the chin bar including a left side and a right side, the left side of the chin bar including first and second left side branches, and the right side of the chin bar including first and second right side branches, wherein the first recessed portion of the left side outer surface of the shell is configured to receive the first branch of the left side of the chin bar, the second recessed portion of the left side outer surface is configured to receive the second branch of the left side of the chin bar, the first recessed portion of the right side outer surface of the shell is configured to receive the first branch of the right side of the chin bar, and the second recessed portion of the right side outer surface of the shell is configured to receive the second branch of the right side of the chin bar; and a face guard mountable to the shell and configured to protect the wearer's face;

wherein the first left side branch extends from the chin bar to a first branch end on the left side portion of the shell, the second left side branch extends from the chin bar to a second branch end on the left side portion of the shell, the first right side branch extends from the chin bar to a third branch end on the right side portion of the shell, and the second right side branch extends from the chin bar to a fourth branch end on the right side portion of the shell.

23. A helmet as in claim 22, wherein the chin bar is fastened to a lower portion of the face guard.

24. A helmet as in claim 22, wherein the chin bar is made of plastic and the face guard is made of metal.

25. A helmet as in claim 22, wherein the shell is molded with the first and second left side recessed portions and the first and second right side recessed portions.

26. A helmet for protecting a wearer's head, the helmet comprising:

a protective shell including a left side portion with a left front edge, and a right side portion with a right front edge, the left side portion comprising a left side outer surface including a first left side recessed portion molded into the protective shell, and the right side portion comprising a right side outer surface including a first right side recessed portion molded into the protective shell;

a face guard mountable to the shell and configured to protect the wearer's face, the face guard having a bottom edge; and a chin bar fastenable to the shell to extend forward of the left and right front edges, the chin bar including a top edge positioned opposed to the bottom edge of the face guard, the chin bar further including a left side and a right side, the left side of the chin bar including a first left side branch, and the right side of the chin bar including a first right side branch, wherein the first recessed portion of the left side outer surface of the shell is configured to receive the first branch of the left side of the chin bar, and the first recessed portion of the right side outer surface of the shell is configured to receive the first branch of the right side of the chin bar;

wherein:

the left side outer surface further comprises a second left side recessed portion molded into the protective shell;

the right side outer surface further comprises a second right side recessed portion molded into the protective shell;

the left side of the chin bar includes a second left side branch;

the right side of the chin bar includes a second right side branch;

the second recessed portion of the left side outer surface of the shell is configured to receive the second branch of the left side of the chin bar; and the second recessed portion of the right side outer surface of the shell is configured to receive the second branch of the right side of the chin bar; and the first left side branch extends from the chin bar to a first branch end on the left side portion of the shell, the second left side branch extends from the chin bar to a second branch end on the left side portion of the shell, the first right side branch extends from the chin bar to a third branch end on the right side portion of the shell, and the second right side branch extends from the chin bar to a fourth branch end on the right side portion of the shell.

27. A helmet as in claim 26, wherein the chin bar is fastened to a lower portion of the face guard.

28. A helmet as in claim 26, wherein the face guard comprises a wire cage.

29. A helmet as in claim 26, wherein the chin bar is made of plastic and the face guard is made of metal.

30. A helmet for protecting a wearer's head, the helmet comprising:

a protective shell including a left side portion with a left front edge, and a right side portion with a right front edge, the left side portion comprising a left side outer surface including a first left side recessed portion recessed into the left side outer surface of the protective shell, and the right side portion comprising a right side outer surface including a first right side recessed portion recessed into the right side outer surface of the protective shell;

a chin bar, the chin bar being fastenable to the shell to extend forward of the left and right front edges, the chin bar including a left side and a right side, the left side of the chin bar including a first left side branch, and the right side of the chin bar including a first right side branch, wherein the first recessed portion of the left side surface of the shell is configured to receive the first branch of the left side of the chin bar, the first recessed portion of the right side surface of the shell is configured to receive the first branch of the right side of the chin bar; and a face guard mountable to the shell and configured to protect the wearer's face, the face guard having a left lateral side that overlies a portion of the shell left side portion that is not recessed, and the face guard further having a right lateral side that overlies a portion of the shell right side portion that is not recessed;

wherein the chin bar is made of plastic and the face guard is made of metal.

31. A helmet as in claim 30, wherein the chin bar is fastened to a lower portion of the face guard.

32. A helmet as in claim 30, wherein the face guard has a bottom edge, and the chin bar includes a top edge positioned opposed to the bottom edge of the face guard.

33. A helmet as in claim 30, wherein the face guard comprises a wire cage.

34. A helmet as in claim 30, wherein the first left side recessed portion is molded into the protective shell, and the first right side recessed portion is molded into the protective shell.

* * * * *